US005138666A

United States Patent [19]

Bauer et al.

[11] Patent Number: 5,138,666

[45] Date of Patent: Aug. 11, 1992

[54] VOICE TRANSMISSION SYSTEM

[75] Inventors: Alfred Bauer, Parma; Thomas A. Dobbins, Cleveland Heights, both of Ohio

[73] Assignee: Actron Manufacturing Company, Cleveland, Ohio

[21] Appl. No.: 758,707

[22] Filed: Sep. 9, 1991

Related U.S. Application Data

[63] Continuation of Ser. No. 433,601, Nov. 8, 1989, abandoned, which is a continuation-in-part of Ser. No. 430,091, Oct. 27, 1989, abandoned, which is a continuation of Ser. No. 186,932, Apr. 27, 1988, abandoned, which is a continuation-in-part of Ser. No. 134,934, Dec. 18, 1987, Pat. No. 4,901,356.

[51] Int. Cl.[5] ..... H04R 25/00; A62B 18/08; A42B 1/24

[52] U.S. Cl. ..... 381/169; 381/183; 381/187; 381/168; 128/201.19; 2/422

[58] Field of Search ..... 381/169, 168, 183, 187, 381/75; 379/430; 181/22, 21; 2/422; 24/17.13; 292/202, 204; 128/201.19

[56] References Cited

U.S. PATENT DOCUMENTS

| | | | |
|---|---|---|---|
| 1,139,177 | 5/1915 | Ganzer | 379/430 |
| 1,242,672 | 10/1917 | Finley . | |
| 1,344,349 | 6/1920 | Mickelson | 379/430 |
| 1,656,914 | 1/1928 | Hart | 181/22 |
| 2,942,072 | 6/1960 | Cunningham . | |
| 2,950,360 | 8/1960 | Duncan . | |
| 2,953,129 | 9/1960 | Bloom et al. . | |
| 3,180,333 | 4/1965 | Lewis . | |
| 3,243,511 | 3/1966 | Erdman et al. . | |
| 3,314,424 | 4/1967 | Berman | 128/201.19 |
| 3,850,168 | 11/1974 | Ferguson et al. | 381/169 |
| 4,072,831 | 2/1978 | Joscelyn . | |
| 4,194,096 | 3/1980 | Ramsey | 381/169 |
| 4,237,341 | 12/1980 | Richards . | |
| 4,374,301 | 2/1983 | Frieder, Jr. . | |
| 4,400,591 | 8/1983 | Jennings et al. . | |
| 4,471,174 | 9/1984 | Nava . | |
| 4,508,936 | 4/1985 | Ingalls . | |
| 4,683,588 | 7/1987 | Goldberg . | |
| 4,736,740 | 4/1988 | Parker et al. | 128/201.19 |
| 4,756,308 | 7/1988 | Ryback | 128/201.19 |
| 4,957,106 | 9/1990 | Vandeputte | 128/201.19 |
| 4,961,420 | 10/1990 | Cappa et al. | 128/201.19 |

FOREIGN PATENT DOCUMENTS

| | | | |
|---|---|---|---|
| 492664 | 9/1938 | United Kingdom | 381/187 |
| 549518 | 11/1942 | United Kingdom | 381/187 |
| 2165721 | 4/1986 | United Kingdom . | |

*Primary Examiner*—James L. Dwyer
*Assistant Examiner*—Jason Chan
*Attorney, Agent, or Firm*—Calfee, Halter & Griswold

[57] ABSTRACT

The invention provides a combined microphone and amplifier assembly that is releasably connected to the voice emitter passage of a conventional face mask without requiring any penetration or structural modification of the face mask including the voice emitter passage of the mask. The combined microphone and amplifier assembly includes a body mounting and enclosing within a main compartment an amplifier circuit board and a speaker. The body further includes one or more battery compartments having selectively removable covers which afford ready access to the batteries contained within the compartments. Connected to the body is a mounting bracket that facilitates the quick and easy releasable connection of the combined microphone and amplifier assembly to the mask without any penetration or structural modification of the mask being required.

19 Claims, 22 Drawing Sheets

VOICE TRANSMISSION SYSTEM

This is a continuation of copending application Ser. No. 07/433,601 filed on Nov. 8, 1989, now abandoned, which is a continuation-in-part of application Ser. No. 430,091 filed Oct. 27, 1987, now abandoned, which is a continuation of application Ser. No. 07/186,932 filed Apr. 27, 1988, now abandoned, which is a continuation-in-part of application Ser. No. 07/134,934 filed on Dec. 18, 1989, and entitled "Voice Transmission System", now U.S. Pat. No. 4,901,356.

FIELD OF THE INVENTION

The present invention relates to a voice transmission or communication systems for gas or face masks. More particularly, the present invention relates to a combined microphone and amplifier assembly for amplifying the mask user's voice.

BACKGROUND OF THE INVENTION

Protective gas masks for the human face are well known. People wearing the gas masks often have a need to communicate with one another, particularly in emergency situations. Several communication systems have been developed for this purpose.

For example, Berman U.S. Pat. No. 3,314,424 includes a microphone inside the mask and an amplifier assembly outside the mask, with an electrical cable extending therebetween and passing through a sealed grommet in the mask. Bergman U.S. Pat. No. 3,243,511, assigned to the same company as the Berman patent, shows substantially the same mask as the Berman patent with the amplifier circuit being disclosed.

Lewis U.S. Pat. No. 3,180,333 discloses a gas mask communication system including a generally U-shaped holder connected to the mask. Preferably, the holder includes the amplification speaker in one end portion thereof and the batteries for operating the speaker system in the other end portion thereof. The batteries and amplification system are connected in circuit with a microphone inside the mask adjacent the user's mouth. Additional or parallel speakers can be plugged into the Lewis mask communication system including, for example, a speaker attached to the belt of the wearer.

Ingels U.S. Pat. No. 4,508,936, Bloom U.S. Pat. No. 2,953,129 and Duncan U.S. Pat. No. 2,950,360 disclose face mask communication systems having a microphone carried in the face mask and an amplifier or speaker externally coupled to the face mask for support elsewhere, such as around the waist of the user. These voice communication systems for masks have several disadvantages. First, the attachment of the amplifier or speaker to the waist adds weight and bulk to the unit and partially limits the mobility of the wearer. Second, the person wearing the mask often turns his head during an emergency situation to talk, but the amplifier or speaker on his waist does not simultaneously turn since his body does not turn. Thus, the wearer is attempting to project his voice in one direction but the voice is actually being transmitted in a different direction. By having the face and amplifier or speaker potentially as much as 90° apart in direction, the efficiency and effectiveness of the voice transmission and projection is diminished.

SUMMARY OF THE INVENTION

A principle object of the present invention is to have a microphone assembly and amplifier assembly that are readily connected to one another and to the existing emitter passage of a gas or face mask. To this end, the emitter passage has a female threaded section adjacent its end normally to house a voice emitter diaphragm held in place by a perforated cover. With the present invention, the voice emitter diaphragm and cover can be readily removed, the microphone assembly can be screwed into the female section of the emitter passage and the amplifier assembly can be screwed into the microphone assembly.

Yet another object of the present invention is to provide a positive resilient electrical contact between the amplifier assembly and the microphone assembly during installation. The microphone assembly is provided with two spaced circular contacts on the end thereof. These circular contacts are engaged by spring loaded pins or ball contacts carried by the amplifier assembly. The spring loaded pins or ball contacts are normally urged to a position guaranteeing positive engagement with the contacts when the amplifier assembly is fully threaded onto the microphone assembly.

Another object of the present invention is to provide a compact and lightweight voice transmission system that follows the head of the mask user. The microphone assembly and amplifier assembly of the present invention employ relatively small, plastic bodies reducing the weight and enhancing the compactness of the system. By threadedly coupling the microphone assembly and amplifier assembly to the emitter passage or by clipping, wedging or strapping the combined microphone and amplifier assembly to the mask, the lightweight and compact voice transmission and amplification system of the present invention follows the head of the user to project the person's voice in the direction his face is pointing.

Still another object of the present invention is to provide a combined microphone and amplifier assembly that can be readily removably coupled to an existing emitter passage of a gas or face mask without penetrating or structurally modifying the existing mask or its emitter passage. For this purpose, a mounting bracket is included with the combined microphone and amplifier assembly. The mounting bracket may include spring clips, a rotatable locking pin or elastic straps resiliently cooperating with a portion of the mask removably to mount the assembly in juxtaposition on and in alignment with the voice emitter passage. The mounting bracket facilitates attachment without any special tools, without making threaded connections, without penetrating the mask and without structurally modifying or altering the mask.

An additional object of the present inventor is to provide a combined microphone and amplifier assembly that allows the quick and easy replacement of the battery that powers the system. The combined microphone assembly of the present invention provides battery compartments with removable covers that permit the replacement of the battery even when the combined microphone amplifier assembly is attached to the mask and the mask is being worn by the user.

These and other objects and advantages of the present invention will become apparent as the following description proceeds.

To the accomplishment of the foregoing and related ends the invention, then, comprises the features hereinafter fully described and particularly pointed out of the claims, the following description and the annexed drawings setting forth in detail certain illustrative embodiments of the invention, these being indicative, however, of but a few of the various ways in which the principle of the invention may be employed.

DETAILED DESCRIPTION OF THE DRAWINGS

DETAILED DESCRIPTION OF THE PREFERRED EMBODIMENT

Figure 1:
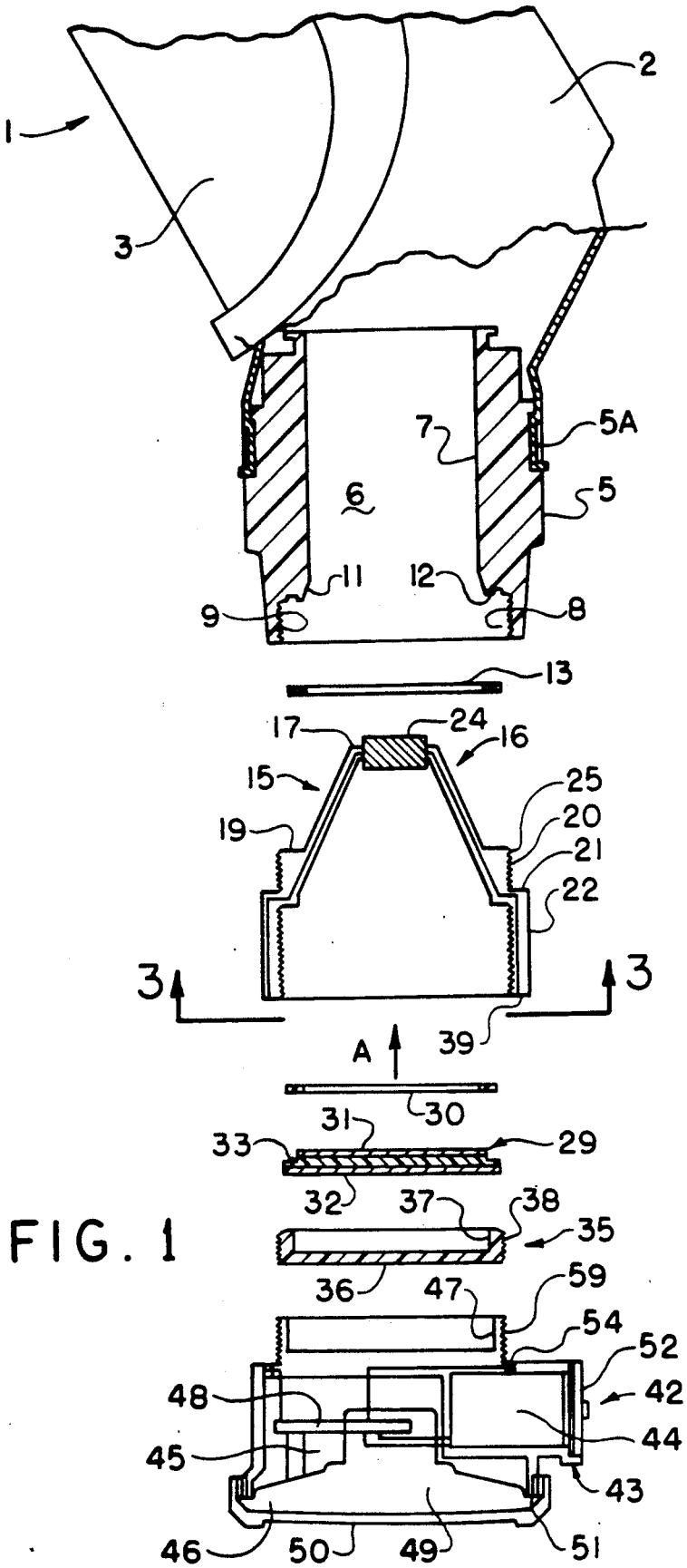
FIG. 1 is an exploded view of the components of the voice transmission system of one embodiment of the present invention prior to assembly or installation of the gas mask.
Figure 2:
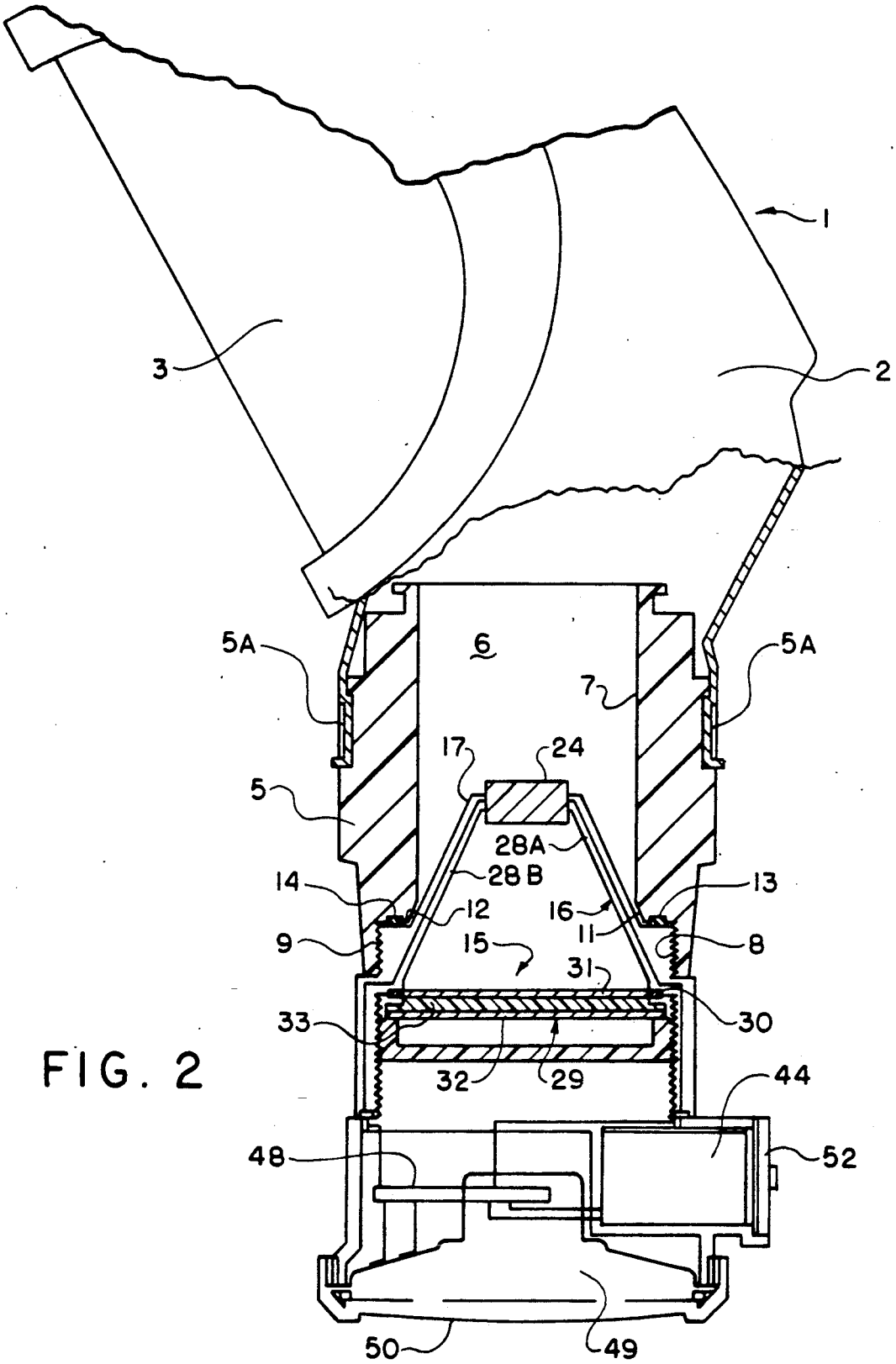
FIG. 2 is a vertical elevation partially in section showing the microphone assembly and amplifier assembly of FIG. 1 installed on the emitter passage of a gas mask used to protect the face of a person, such as a fire fighter.
Figure 6:
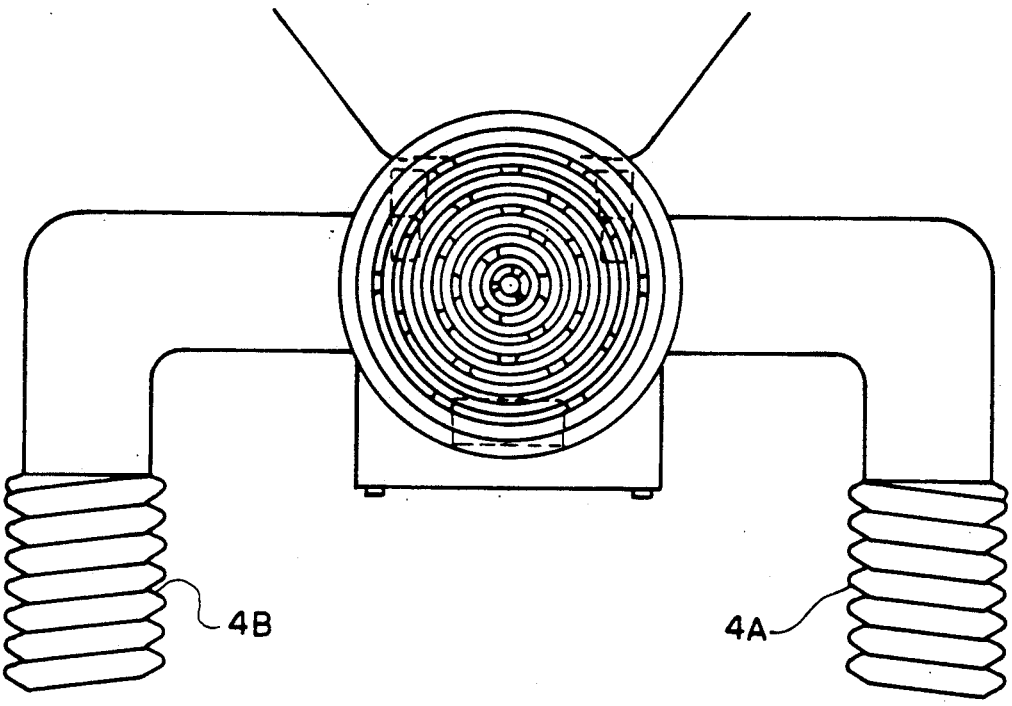
FIG. 6 is a front view of part of the mask and the voice transmission system of the present invention.

Turning now in more detail to the drawings and initially to FIGS. 1 and 2, a gas or face mask, indicated generally at 1, includes a face piece 2 held tightly against the head of the user by straps encircling the back of the head. A transparent viewing plate 3 is mounted in and sealingly secured to the face piece 2. A person wearing the mask 1 on inhaling receives filtered air drawn through a conventional inhalation tube 4A and on exhaling exhausts air through a conventional exhalation tube 4B. The inhalation and exhalation tubes have check valves and filters mounted therein to preclude noxious gases or contaminants entrained in the air from entering the end of face piece 2 and transparent face plate 3.

A person wearing the face mask often needs to communicate with other people in the area. For this purpose, a conventional plastic voice emitter body 5 is secured to the mask 1 by a clamp 5A received in an external groove on body 5. The emitter body 5 has a stepped emitter passage 6 extending therethrough and being formed by bore 7 and counterbore 8. The counterbore 8 has female threads 9 thereon which normally mate with threads on the perforated cover retaining a voice emitter diaphragm in the emitter passage. A chamfered relief 11 and shoulder 12 are formed between the bore 7 and counterbore 8. A circular flat rubber seal 13 is mounted in an annular groove 14 provided in shoulder 12.

A microphone assembly indicated generally at 15 is partially received in and threadedly mounted to the emitter passage. The microphone assembly includes a lightweight plastic body 16 having an inner end face 17, two diametrically opposed, angled spokes 18, a first radially projecting annular shoulder 19, a first axially extending annular wall 20, a second radially projecting annular shoulder 21 and a second enlarged diameter axially extending wall 22.

The inner end wall 17 has a microphone cartridge 24 mounted therein. This microphone cartridge is sold by Cord Electronics, Inc. under part number U62B.

The radially outer surface of the first axial wall 20 of microphone assembly body 16 has male threads 25 thereon. The microphone assembly body 16 is screwed into the emitter passage 6 with threads 25 mating with threads 9 on counterbore 8. Body 16 is threadedly advanced into the emitter passage until the inner end of first annular shoulder 19 bottoms out on and compresses circular flat rubber seal 13. The microphone assembly body is then properly positioned in and sealed to the emitter body 5 to preclude outside air from entering mask 1. The radially inner surface of the second axial wall 22 of the microphone assembly body 16 has female threads 26. Electrical leads 28A and 28B are connected at their inner respective ends to opposite sides of microphone cartridge 24 and extend through and are embedded in the microphone assembly body 16 to the forward end wall thereof as will be described in more detail below.

A voice emitter diaphragm 29 is mounted in the microphone assembly 15 in a position inside second axially extending wall 22 against or immediately adjacent the inner side of second shoulder 21. A circular flat rubber seal 30 is mounted on the internal side of shoulder 21, with the voice emitter diaphragm 29 engaging the circular flat rubber seal 30 to provide airtight sealing contact therebetween. The voice emitter diaphragm includes parallel plates 31 and 32 having a layer of mylar 33 sandwiched therebetween. The voice emitter diaphragm blocks noxious or contaminated air from entering the microphone assembly while being capable of transmitting some sound therethrough.

The voice emitter diaphragm 29 is held in position by a dish lock ring, indicated generally at 35, having a base wall 36 and an annular sidewall 37. The radially outer surface of sidewall 37 is threaded as indicated at 38. The dish shaped lock ring 35 is threaded down the female threads 26 on second axial wall 22 of the microphone assembly body. Lock ring 35 bears against plate 32 of the voice emitter diaphragm 29 to hold the same against circular flat rubber seal 30.

Figure 3:
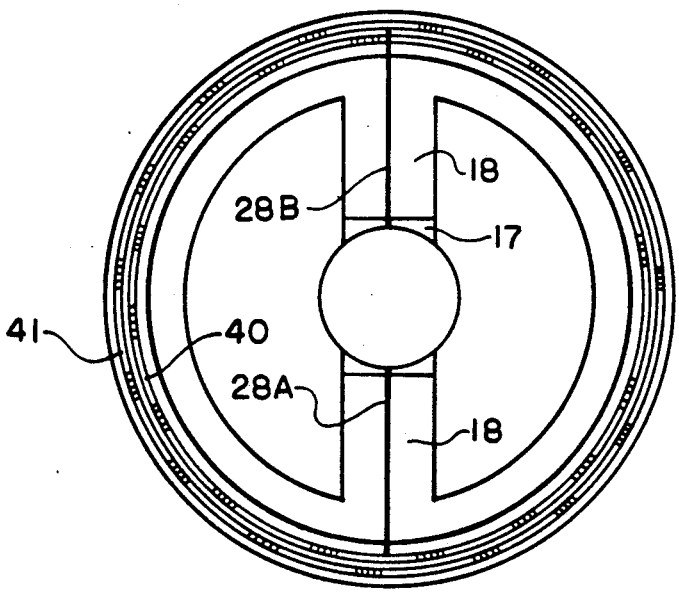
FIG. 3 is an enlarged end view of the plastic body of the microphone assembly as taken on the plane 3—3 of FIG. 1 showing the concentric circular contacts carried by the outer end of that body.
Figure 4:
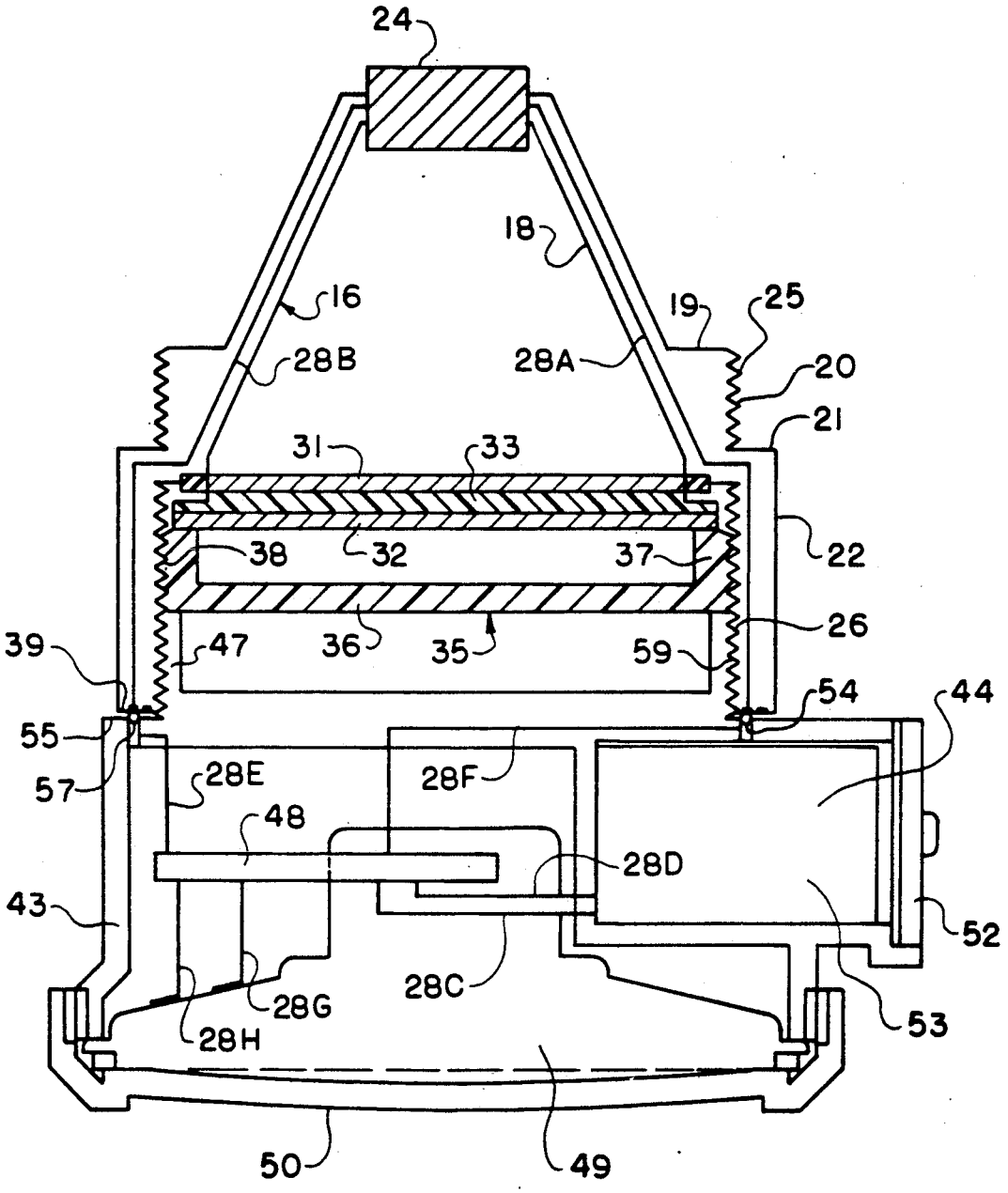
FIG. 4 is an enlarged section of the microphone assembly and amplifier assembly as installed with the electrical circuit and end contacts being schematically illustrated.
Figure 5:
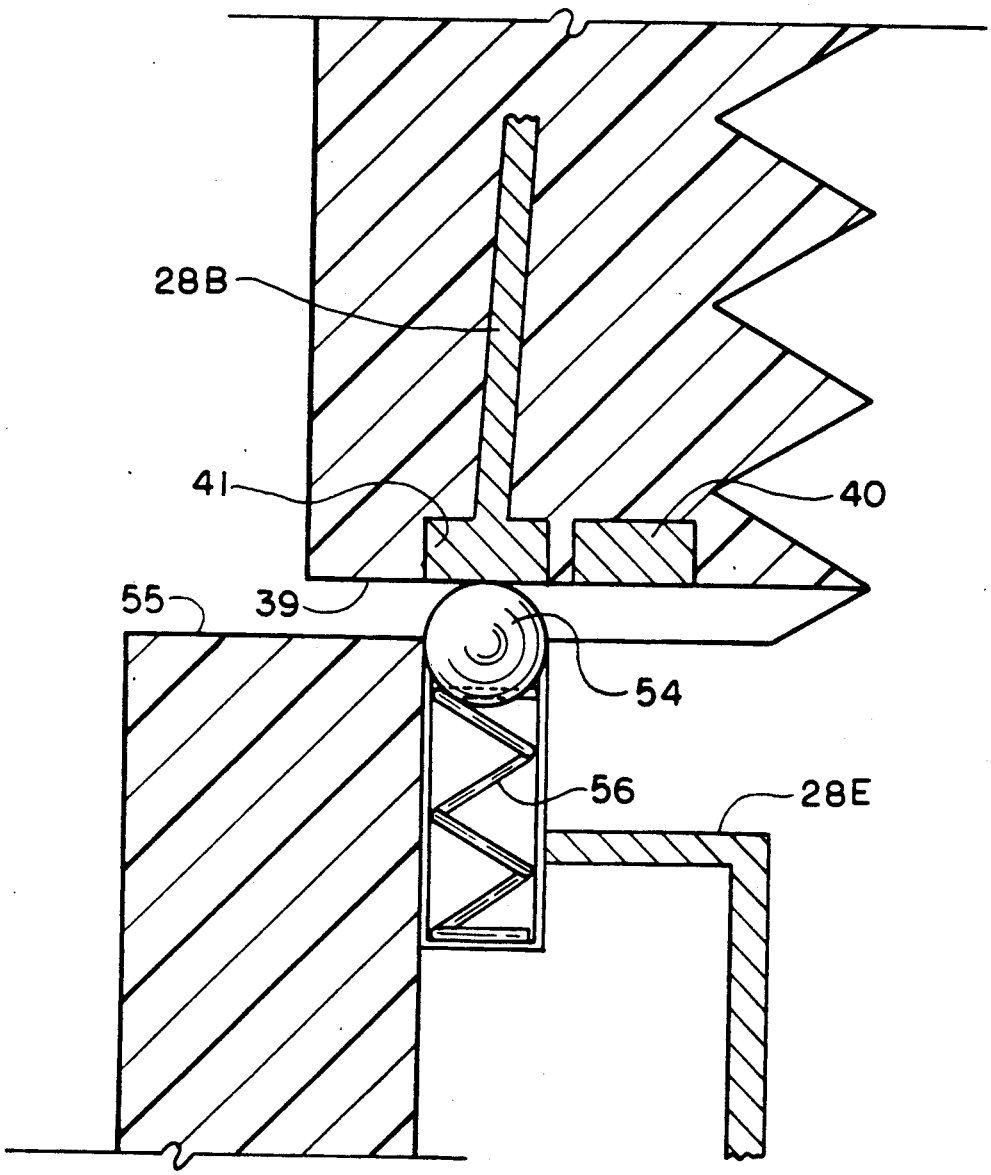
FIG. 5 is an enlarged view of the spring load contactor ball carried by the amplifier assembly prior to making engagement with the contact on the end of the microphone assembly body.

The end face 39 of microphone assembly body 16 has two spaced circular electrical contacts 40 and 41. These concentric circular contacts 40 and 41 are respectively connected to leads 28A and 28B in body 16 as best shown in FIG. 3. Spaced circular contacts 40 and 41 are adapted to provide an electrical connection with the amplifier assembly, indicated generally at 42.

The amplifier assembly 42 includes a lightweight, preferably integrally molded, plastic body 43 having a battery compartment 44, an open forward end 46 and an inner sleeve 47. An amplifier board 48 and speaker 49 are mounted in main compartment 45 of body 43. The amplifier board 48 may be purchased from SGS Semiconductor under part number TDA1904, and the speaker 49 may be purchased from Cord Electronics, Inc. under part number 70 RPOSN-4. A perforated speaker cover 50 is threaded onto body 44 as indicated at 51 to cover the outer end of the speaker 49 and the open end 46 of body 44.

The battery compartment 44 has a selectively removable cover 52. When the cover is off, a 9V battery 53 may be positioned in the battery compartment 44 to provide a source of power for the voice transmission system of the present invention. Leads 28C and 28D extend from the battery terminals to the amplifier board 48. Lead 28E extends from the amplifier board to a metallic contactor ball 57 positioned on a base wall 55 of amplifier assembly body 43. The contactor ball 57 is spring biased as indicated at 56 normally resiliently to urge the ball 57 forwardly. Instead of the ball illustrated, it will be appreciated that a metallic pin could be used as the contactor. A second spring loaded contactor ball 54 is mounted on base wall 55 in a position generally diametrically opposite ball 57. Spring loaded balls 57 and 54 are adapted respectively positively to engage circular contacts 41 and 40 on the microphone assembly when the amplifier assembly is screwed onto the microphone assembly.

To this end, the radially outer surface of sleeve 47 has male threads 59 thereon. Male threads 59 mate with female threads 26 internally positioned on the second axially extending wall 22 of the microphone assembly body 16. The amplifier assembly is threadedly advanced into the microphone assembly until the inner end of sleeve 47 bottoms out against base wall 36 of lock ring 35. In such position, the base wall 55 of body 43 also abuts the end face 39 of microphone assembly body 16. Since the balls 54 and 57 normally extend forwardly of base wall 55, the balls 54 and 57 will be depressed against their respective contacts to insure a positive electrical contact.

Spring loaded ball 54 has electrical lead 28F extending through body 43 to a connection with amplifier board 48. Electrical leads 28G and 28H extend from the amplifier board to the speaker 49. Leads 28A through 28H thus provide a closed electrical circuit between the battery 53, the amplifier board 48, the microphone cartridge 24, and the speaker 49 when the amplifier assembly is fully threaded onto the microphone assembly providing an electrical connection therebetween. The electrical circuit schematically disclosed herein includes additional capacitors and resistors (not shown). The circuit is basically conventional and does not form part of this invention except for the means of making electrical contact between the amplifier assembly and microphone assembly.

As will be appreciated, the microphone cartridge 24 is positioned inside the mask adjacent the mouth of the user while the speaker 48 is pointed outwardly on the outside of the mask. The microphone assembly and amplifier assembly can be readily operably connected by completing two threaded connections. If the amplifier assembly malfunctions for any reason, the masked user can quickly disassemble the amplifier assembly by unthreading the same from the microphone assembly. By doing this, the user's voice can then be transmitted through the diaphragm assembly 29.

Figure 7:
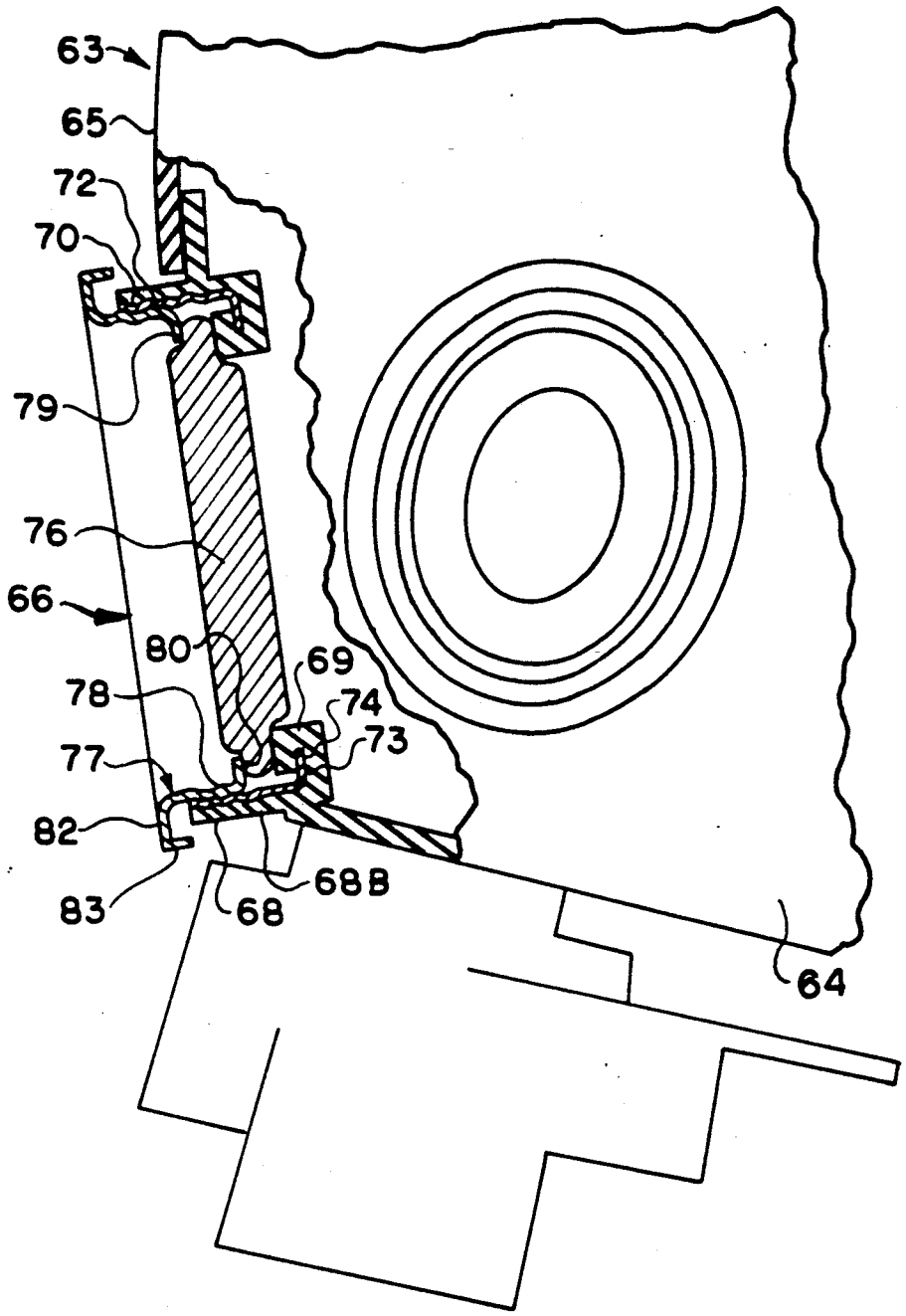
FIG. 7 is a side elevation of another protective face mask having a cut away portion to show the voice emitter passage in cross section.
Figure 8:
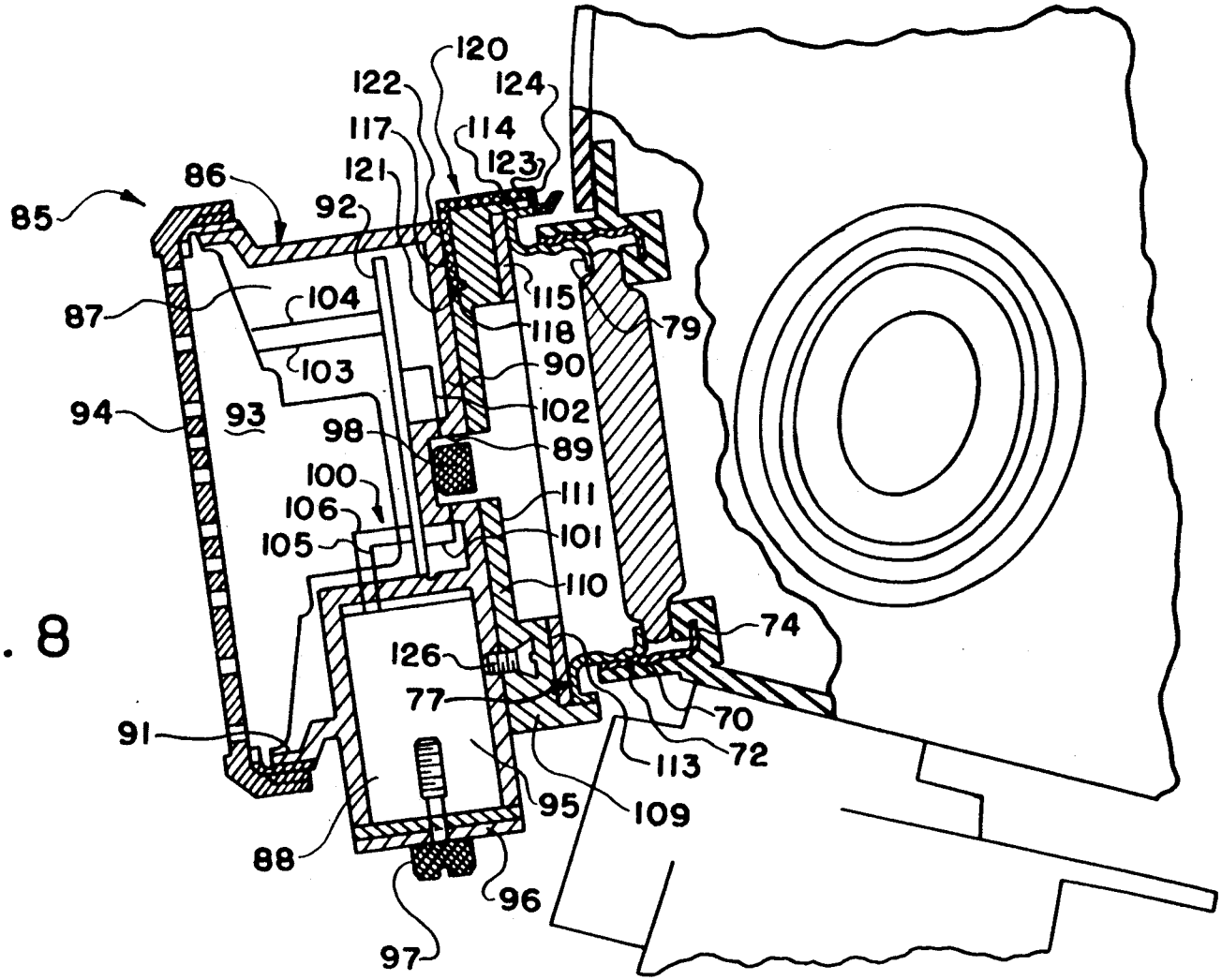
FIG. 8 is a side elevation of the face mask of FIG. 7 showing the combined microphone and amplifier assembly made in accordance with the present invention mounted in juxtaposition on and in alignment with the emitter passage by a spring clip mounting embodiment.

Turning now to a second embodiment shown in FIGS. 7 and 8, a gas mask, indicated generally at 63, includes a face piece 64 held tightly against the head of the user by straps encircling the back of the head. A transparent viewing plate 65 is mounted in and sealingly secured to the face piece 64. The face piece 64 includes a voice emitter passage indicated generally at 66.

The emitter passage 66 is defined by a bore through a plastic annular body 68. The preferably integrally molded body 68 has a generally cylindrical wall portion 68B and a radially inwardly extending shoulder portion 69. The generally cylindrical portion 68B has an internal surface with spaced ribs 70 therealong frictionally cooperating with the ribbed external surface on a ferrule 72. The ferrule has a radially inwardly extending annular shoulder 73 secured in a circumferentially continuous groove 74 in shoulder 69 of the body 68. The ferrule 72 is thus held tightly in position along the bore of the body 68 by a frictional rib interfit and by the shoulder and groove connection.

An emitter diaphragm 76 is mounted in and extends across the bore through the emitter passage body. The voice emitter diaphragm 76, which may have the construction shown in FIGS. 1 and 2, blocks noxious or contaminated air from entering the microphone assembly while being capable of transmitting some sound therethrough. The voice emitter diaphragm 76 is held in position by a sleeve, indicated generally at 77.

The sleeve 77 includes a ribbed cylindrical portion 78 frictionally interlocking with the ribbed cylindrical portion of ferrule 72 removably to mount the sleeve in the emitter passage assembly. The sleeve 77 includes a radially inwardly turned annular abutment shoulder 79 engaging the circumferentially continuous marginal edge 80 of the voice emitter diaphragm 76. The marginal edge 80 of the voice emitter diaphragm is thus sandwiched between and held by abutment shoulder 79 of sleeve 77 and shoulder 69 of the voice emitter body 68.

The sleeve 77 includes a radially outwardly turned rim 82 at its front end having an annularly continuous, rearwardly directed lip 83. The rim 82 and lip 83 are used selectively to secure a combined microphone and amplifier assembly to mask 63 as described in more detail below.

The combined microphone and amplifier assembly is indicated generally at 85 and includes a lightweight plastic body, indicated generally at 86. The body 86 defines a main compartment 87, a battery compartment 88 and a microphone cavity 89. The microphone cavity 89 is formed in the base wall 90 of body 86.

The main compartment 87 has an open end 91 to receive an amplifier board 92 and a speaker 93 mounted therein. The amplifier board 92 and speaker 93 may be enclosed in main chamber 87 by perforated speaker cover 94 selectively being threaded onto main body 86.

The battery compartment 88 has a 9 volt battery 95 positioned therein. The battery 95 provides the source of power for the voice transmission unit. The battery compartment 88 has a removable cover 96 selectively mounted thereon by fasteners 97 to enclose battery 95.

The microphone cavity 89 is formed by a dish shaped recess in bottom wall 90. The microphone cartridge 98 is received within and secured to the microphone cavity 89. The microphone cartridge 98 is electrically coupled to the other elements of the combined microphone and amplifier assembly by an electrical circuit, indicated generally at 100.

The electrical circuit 100 includes electrical leads 101 and 102 between the microphone cartridge 98 and the amplifier board 92. The electrical circuit further includes electrical leads 103 and 104 between the amplifier board 92 and the speaker 93. Finally, the electrical circuit 100 includes electrical leads 105 and 106 between the battery 95 and the amplifier board 92. Leads 101-106 create a closed electrical circuit including the battery 95, the amplifier board 92, the microphone 98 and the speaker 93. The amplifier board, speaker and microphone are the commercially available products described in conjunction with FIG. 1.

As is apparent from FIG. 8, the electrical circuit 100 is entirely carried by and mostly enclosed within housing 86 of the microphone and amplifier assembly 85. The electrical circuit is thus protected from outside contaminants and does not require any special contacts to be made to complete the electrical circuit. The schematically illustrated electrical circuit, which includes additional conventional capacitors and resistors, can be tuned to maximize the desired audio gain in the voice transmission system. The gain is defined as the ratio of the output signal to the input signal, with the output signal being measured in volts across the speaker and the input signal being measured in volts across the microphone. This gain is adjusted to provide for the desired voice transmission when the combined microphone and amplifier assembly is removably connected to the voice emitter sleeve 77.

To this end, a generally dish shaped mounting assembly or bracket 109 has a base wall 110 with a central hole 111. The mounting bracket 109 has a shoulder 113 and a circumferentially continuous outer flange 114. An annular foam gasket 115 is received on shoulder 113 with its outer edge in circumferentially continuous abutment with flange 114.

In the preferred form, the outer surface of bottom wall 110 of mounting bracket 109 has three slots 117 formed therein, preferably equally circumferentially spaced at 120° increments. At their radially inner ends, the slots bend at 90° to form an anchor slot 118. Each of the three slots 117 receives a spring member indicated generally at 120.

Each spring member 120 includes a hook 121 received in the anchor slot 118 and a first leg 122 received in the slot 117. A second leg 123 of the spring member is bent at right angles to the first leg 122 and embraces the radially outer wall of mounting bracket 109. Second leg 123 of spring member 120 terminates in a rebent connection end 124. The three springs are respectively captured in their slots by the mounting bracket 109 being secured by fasteners 126 to bottom wall 90 of the body 86 for the combined microphone and amplifier assembly. Bottom wall 90 thus tightly confines the hook 121 and first leg 122 of each spring 120 in their respective slots to hold the springs in position for purposes of assembly.

In assembly, the combined microphone and amplifier assembly 85 is axially advanced toward the voice emitter body until the rebent terminal connection ends 124 of the springs 120 engage rim 82 on the emitter passage sleeve 77. The springs 120 are resiliently radially outwardly cammed by further advancement ultimately to allow foam gasket 115 compressingly to abut the rim 82 to provide a seal therebetween. In such position, flange 114 on mounting bracket 109 encircles the lip 83 on voice emitter assembly sleeve 77, and the rebent terminal connection ends 124 of the three springs radially contract to overlie the end of lip 83 to provide a releasable connection therebetween.

As thus assembled, the combined microphone and amplifier assembly 86 has been attached to the face mask without special tools and without any threaded connections. The microphone and amplifier assembly is juxtaposed on and in alignment with the emitter passage. The microphone 98 is centered relative to the emitter passage and is in alignment with the hole 111 in mounting bracket 109. With such connection and the proper adjustment of electrical circuit 100, the voice amplification system of this embodiment is operative to transmit the voice of the user without any modifications being made to the voice emitter passage, to the voice emitter or to the mask itself.

Figure 9:
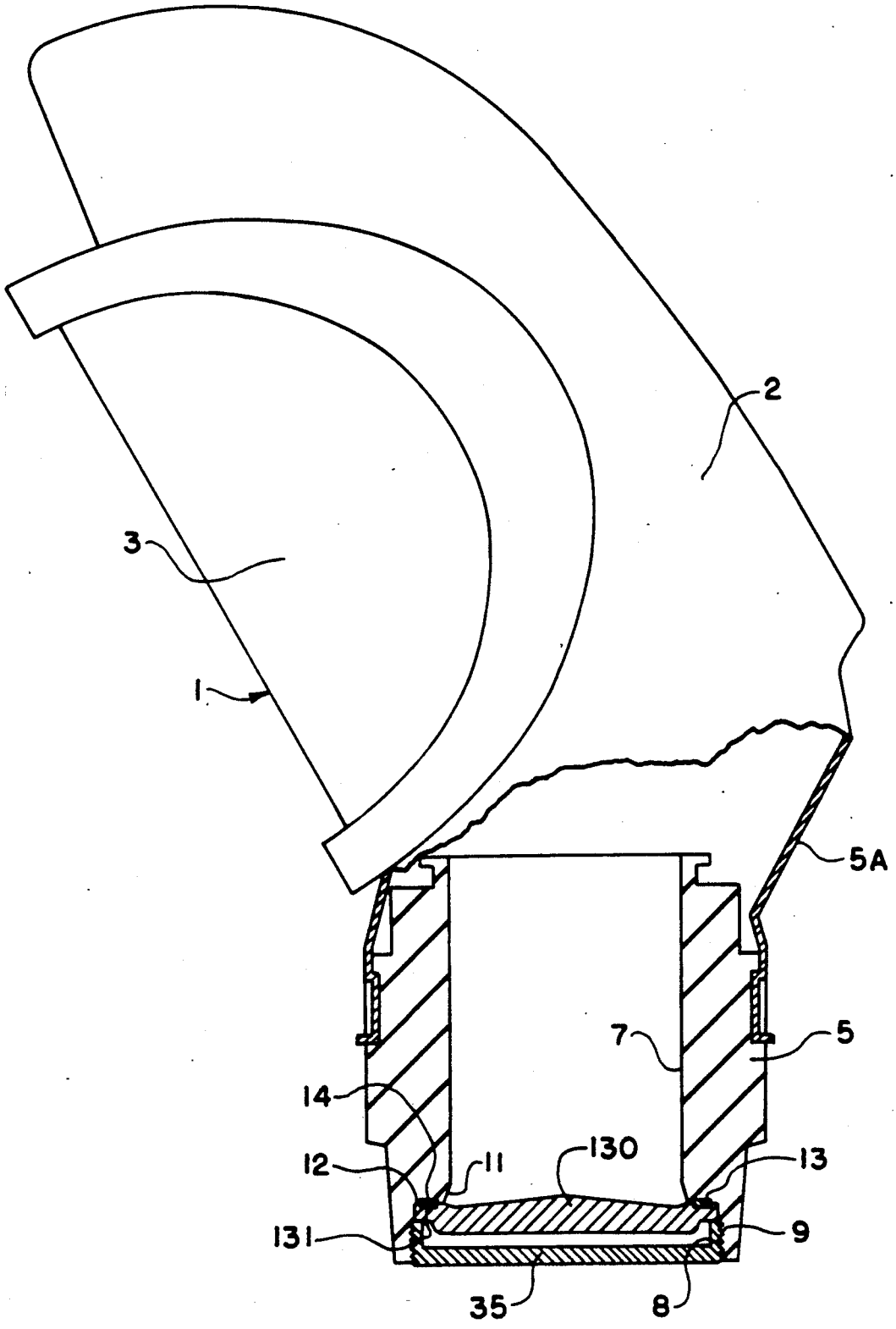
FIG. 9 is a side elevation of the protective face mask shown in FIGS. 1–6 partially broken away to show the emitter passage in cross section before mounting the voice transmission system onto the mask.
Figure 10:
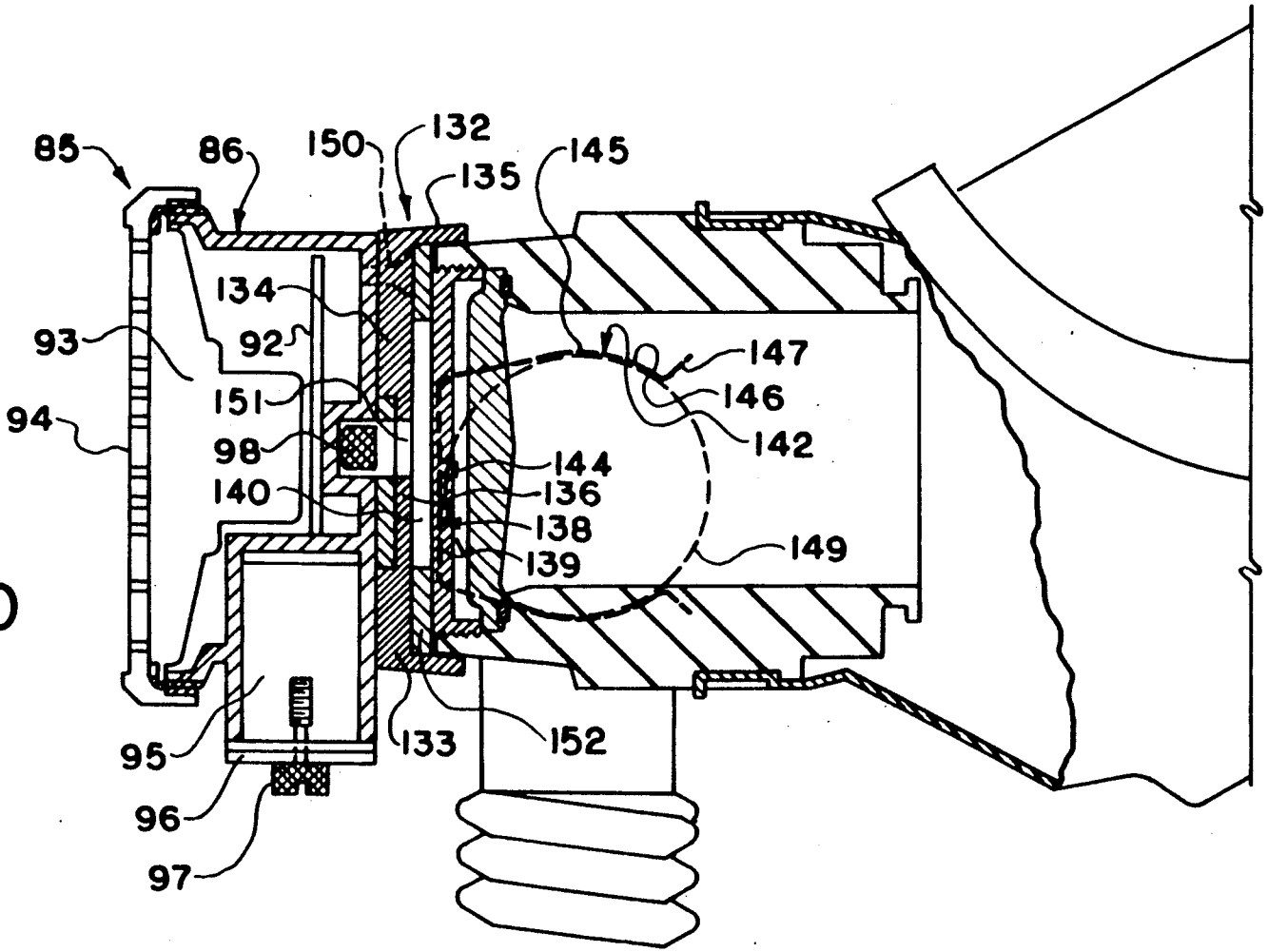
FIG. 10 is an elevation similar to FIG. 9 partially broken away to show the combined microphone and amplifier assembly shown in FIG. 8 removably connected to the emitter passage with another spring clip mounting embodiment.
Figure 11:
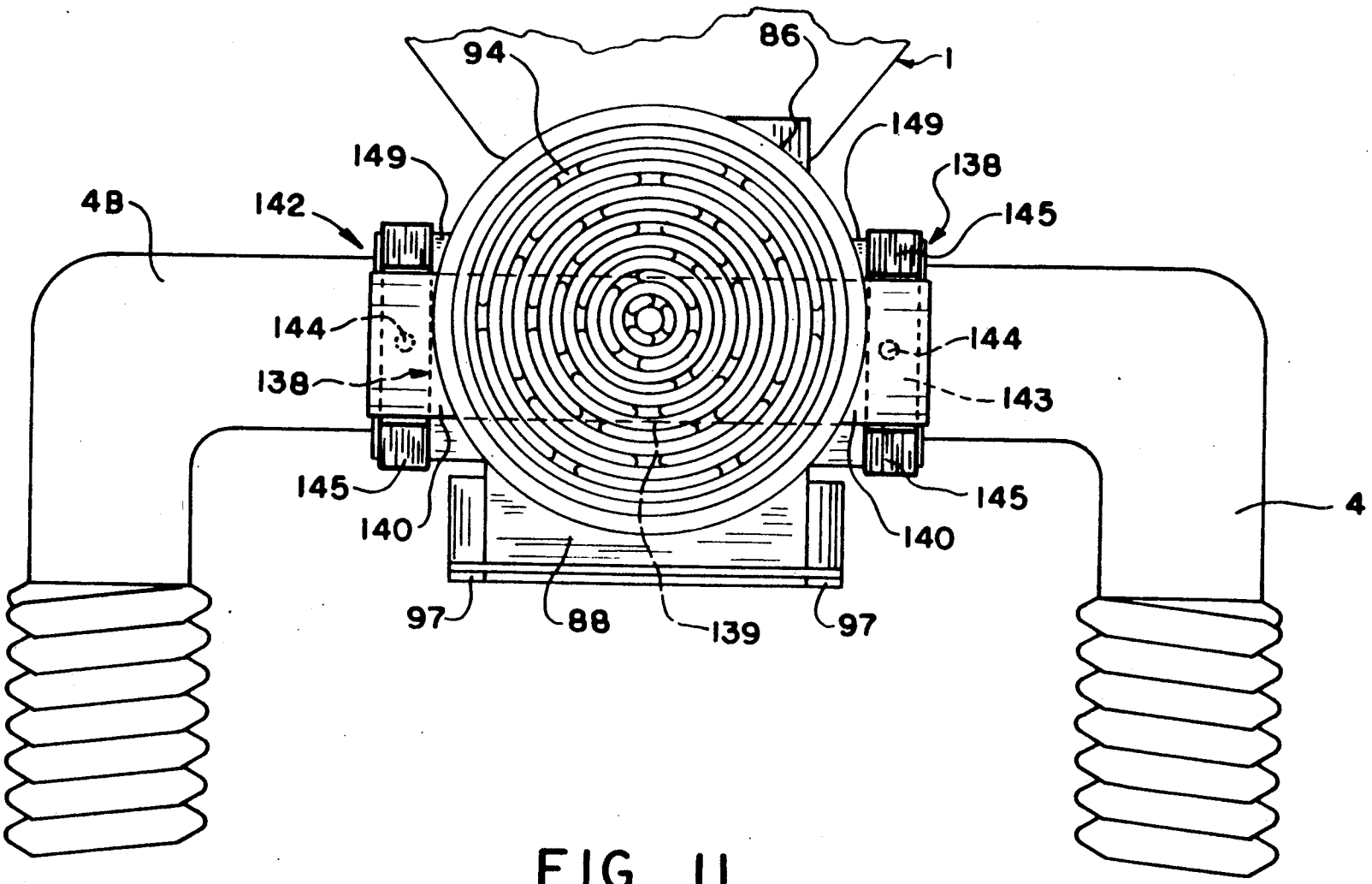
FIG. 11 is a front elevation of the microphone and amplifier assembly of FIG. 10 showing the spring clip connection of the same to the face mask.
Figure 12:
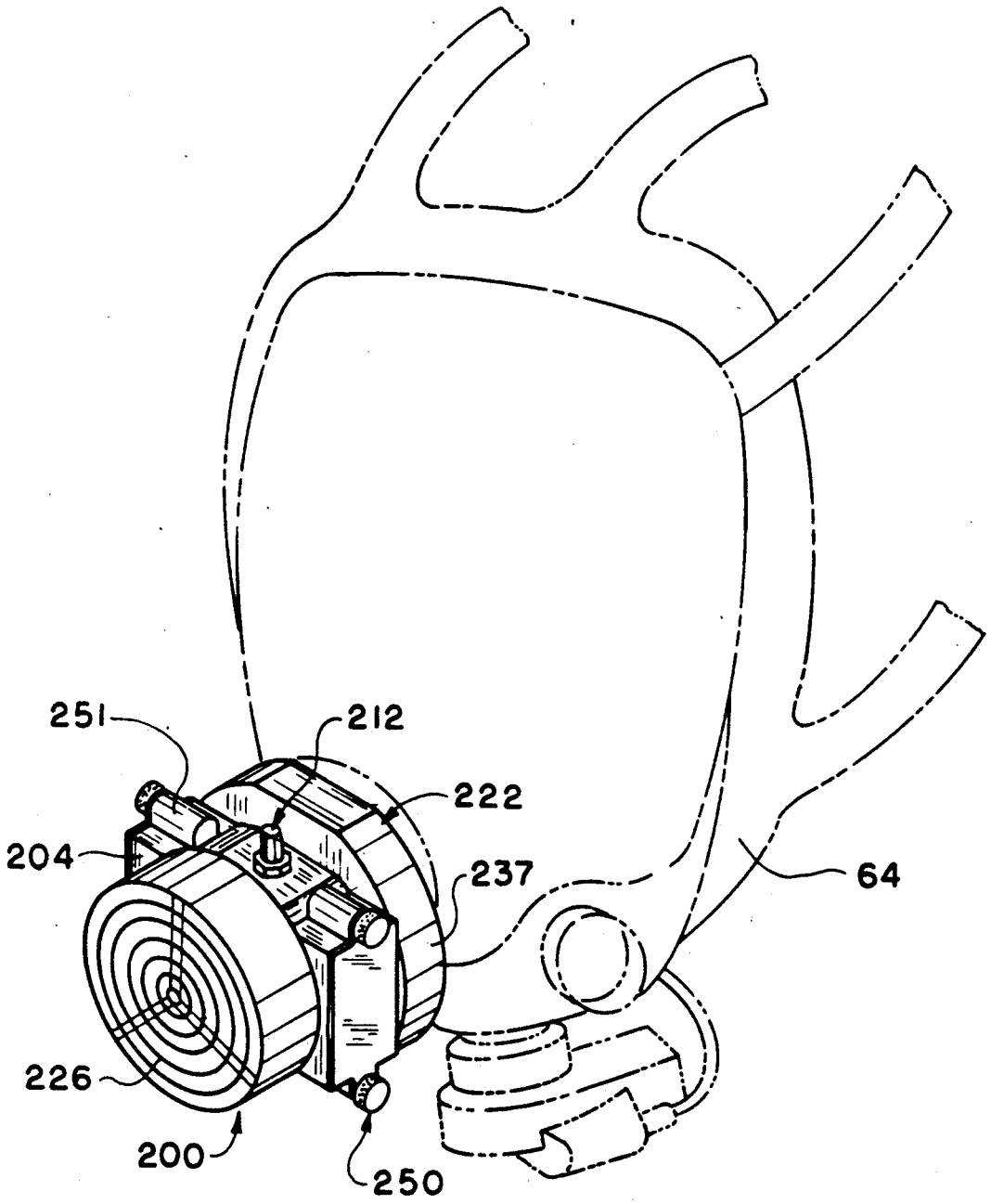
FIG. 12 is a perspective view of another embodiment of a combined microphone and amplifier assembly made in accordance with the principles of the present invention attached to a face mask which is substantially similar to the mask illustrated in FIG. 7.
Figure 15:
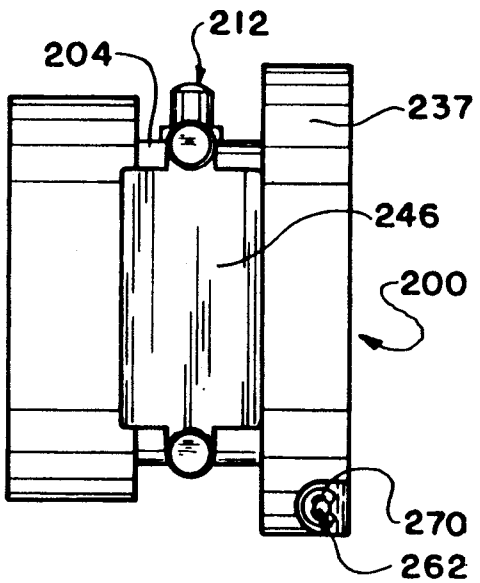
FIG. 15 is a right side view of the combined microphone and amplifier assembly illustrated in FIG. 12.

Turning now to the third embodiment as shown in FIGS. 9 through 11, the same protective face mask is employed as in the first embodiment. Therefore, the same reference numerals have been used in FIGS. 9 through 11 as were used in FIGS. 1 through 3 to identify common face mask and emitter passage structural elements. The voice emitter diaphragm 130 is received in and extends across the emitter passage and is held in place by lock ring 35 being advanced along threads 9 to capture the circumferentially continuous marginal edge 131 between the lock ring wall and the seal 13. A combined microphone and amplifier assembly is connected to the plastic voice emitter body 5.

The combined microphone and amplifier assembly is the same as the combined microphone and amplifier assembly for the second embodiment. The electrical circuit, which is the same as shown in FIG. 8, has been omitted for clarity of illustration. The same reference numerals have been used in FIGS. 10 and 11 for the combined microphone and amplifier assembly as were used for common elements in FIG. 8 for the second embodiment.

The combined microphone and amplifier assembly 85 is removably secured to the voice emitter body 5 by a mounting bracket assembly indicated generally at 132. The mounting bracket assembly 132 includes a generally pan shaped adaptor body 133 having a bottom wall 134 and a circumferentially continuous sidewall 135. The bottom wall 134 of adaptor 135 has a slot 136 in its outer surface, with the slot 136 extending across the entire width of the adaptor body 133.

As best shown in FIG. 11, a mounting bracket, indicated generally at 138, includes a base member 139 that is received in and extends through the slot 136 in the bottom wall 134 of adaptor 133. The opposed ends of the base member 136 extend radially outwardly beyond sidewall 135 of adaptor body 133. The opposed ends of base member 139 have enlarged mounting blocks 140 formed thereon.

Two U-shape spring members, indicated generally at 142, are respectively mounted in spaced relationship onto the mounting blocks 140 by fasteners 144 respectively passing through the base webs 143. Each U-shaped spring 142 includes two spaced resilient spring arms 145 bent rearwardly from and integrally formed with the base web 143. Each spring arm 145 has a central curved section 146 and a radially outwardly bent camming tab 147. The spacing between the spring arms 145 is normally slightly less than the outer diameter of the manifold shoulders 149 of the face mask.

To assemble the combined microphone and amplifier assembly onto the mask, the base member 139 of the mounting bracket assembly 138 is initially positioned in the groove 136 in base wall 134 of adaptor 133. The adaptor 133 is then secured to the base wall 90 of body 86 by fasteners 150. The base member 139 of the mounting bracket is thus rigidly captured between and retained by the adaptor 133 and the base wall 90 of body 86. The adaptor 133 has a central hole 151 in axial alignment with the microphone for voice transmission purposes when the adaptor is secured to the body 86 of the combined microphone and amplifier assembly. An annular foam gasket 152 is secured to the base wall 134 of the adaptor 133 to cooperate with the voice emitter passage of the mask when the combined microphone and amplifier assembly is mounted on the mask.

To this end, the combined microphone and adaptor assembly is axially advanced toward the body 5 defining the voice emitter passage. The camming tabs 147 on each of the spring arms 145 slidingly engage the manifold shoulders 149 resiliently to spread the spring arms to allow the microphone and adaptor assembly to be advanced until seated. When seated, the foam gasket 152 compressingly engages the end of body 5 and lock ring 35 to provide a seal therebetween; the annular sidewall 135 on adaptor 133 encircles a part of body 5 adjacent its end; and the spring arms 145 are resiliently contracted around the manifold shoulders 149 as shown in FIG. 10. The spring arms 145 thus removably secure the microphone and amplifier assembly in juxtaposition on and in axial alignment with the voice emitter passage. The mounting of the microphone and amplifier assembly can be accomplished without special tools and without making threaded connections.

Referring now to FIGS. 12–18 there is illustrated another embodiment of a combined microphone and amplifier assembly 200 made in accordance with the principles of the present invention. Like the two previously described embodiments, the combined microphone and amplifier assembly 200 can be mounted upon a conventional mask without special tools, without making threaded connections, and without penetrating or structurally altering the mask including the voice emitter passage of the mask. Combined microphone and amplifier assembly 200 is adapted for use with the type of conventional mask 64 which is substantially shown in FIGS. 7 and 8. Thus, in FIGS. 12 and 16–18 the same reference numerals have been employed as in FIGS. 7 and 8 to identify common elements of the mask 64.

Combined microphone and amplifier assembly 200 includes an integrally molded plastic body 204. The body 204 includes a main compartment 206 which houses the speaker 208, waterproof speaker cloth 210, an on/off control switch 212 and an amplifier circuit board 214. Combined microphone and amplifier assembly 200 also includes a mounting bracket 222 which facilitates attachment of the combined microphone and amplifier assembly 200 to the face mask 64. Formed by side walls 227 and end walls 228 within bracket 222 is annular microphone cavity 231. Located within microphone cavity 231 is the microphone 218 which is disposed within or encapsulated in a bed of foam rubber 232 in order to help minimize feedback and optimize sound quality. More particularly, foam rubber 232 serves to prevent any vibration caused by speaker 208 from transmitting vibrations through body 204 and back to microphone 218, thus resulting in the production of-feedback. An example of a microphone suitable for use with the combined microphone and amplifier assembly 200 is a microphone sold by Primo Microphone Inc. under part no. EM78.

Located behind the microphone 218 is a circular piece of waterproof speaker cloth 221 and a perforated metal disk 223 which serves to protect the microphone 218. Securely retaining the microphone 218, cloth 221 and metal disk 223 within the microphone cavity 231 is an annular plastic washer 201 that is compression fitted into the microphone cavity 231 flush with the base wall 235 of the mounting bracket 222.

Mounting bracket 222 is secured to body 204 utilizing a plurality of machine screws 224 which extend into threaded posts 225 (shown in FIG. 14) formed along the outside diameter of body 204 such that the heads of screws 224 seat in the rim 229 of mounting bracket 222. Provided between the inner edge 230 of the outer wall 238 of the body 204 and the mounting bracket 222 is a rubber gasket 239 that provides a waterproof and airtight seal between the body 204 and the mounting bracket 222. Rubber gasket 239 also helps to dampen the transmission of vibrations between the mounting bracket 222 and the body 204. Although in the illustrated embodiment mounting bracket 222 is secured to body 204 utilizing machine screws 224, it will be appreciated that the present invention contemplates the use of various other fasteners or glues to attach the mounting bracket 222 to the body 204, and it also contemplates producing the mounting bracket 222 and body 204 as a single piece.

Amplifier circuit board 214 is donut shaped, having a centralized opening 234 adapted to receive the side walls 227 of the microphone cavity 231. Amplifier circuit board 214 is held securely in position within circuit board cavity 233 formed by annular base wall 235, annular end wall 236 and annular sidewall 227, by a suitable wax that may be melted on to the circuit board 214 such that the wax sets up on the board 214 and the end wall 236 of the cavity 233.

Formed by the double outer wall or flange 237, the rim 229 and the end wall 236 of the mounting bracket 222 is an annular cavity 266 for receiving the sleeve 77 of the voice emitter body 5. Located in the annular cavity 266 adjacent the rim 229 is a foam rubber gasket 274. Foam rubber gasket 274 serves to help ensure superior sound reproduction and minimal feedback by providing a watertight and airtight seal between the mounting bracket 222 and the mask 64. Rubber gasket 274 also serves to dampen the transmission of vibrations between the mounting bracket 222 and the mask 64.

Located at the forward end 241 of the body 204 is the removable perforated end cap 226 that is threadedly received within the annular opening of the body 204. End cap 226 serves to securely retain against shelf 289 a circular piece of waterproof speaker cloth 210 and speaker 208 within the main compartment 206 of the body 204. Preferably, speaker 208 is a waterproof speaker and it includes circular rubber seals 277 along the outer and inner edges of the cone 259 of the speaker 208 that form a watertight seal for the annular opening of the main compartment 206 when end cap 226 is firmly threaded into body 204. Rubber seals 277 also serve to dampen the transmission of vibrations between the speaker 208 and the body 204. An example of a waterproof speaker suitable for use in the present invention is a two ohm, 0.5 watt waterproof speaker sold by In Tzong Enterprise. In order to further ensure that the main compartment 206 remains watertight, preferably, the switch 212 includes an encapsulating rubber boot 240 that does not inhibit the operation of switch 212.

Positioned along the outside of the body 204 are a pair of diametrically opposed rectangular battery compartments 242. Battery compartments 242 are formed by sidewalls 243 that extend from the outer wall 238 of body 204. Compartments 242 each include removable covers 246 that provide quick and easy access to the batteries 248 contained in compartments 242. Covers 246 are secured to the openings of the compartments 242 by threaded machine screws 250 that are threadly received in threaded posts 251 formed along the outside edge of side walls 243. By rotating threaded machine screws 250, which include oversized knurled heads 252 to allow easy grasping by a user's fingers, in the counterclockwise direction covers 246 are easily removed. Thus, covers 246 may be removed and the batteries 248 replaced while the combined microphone and amplifier assembly 200 is mounted upon the mask 64 and the mask 64 is positioned on a user's face. By aligning covers 246 with their respective compartments 242, and inserting screws 250 into posts 251 and turning them in the clockwise direction, the covers 246 are secured to the compartments 242.

Figure 14:
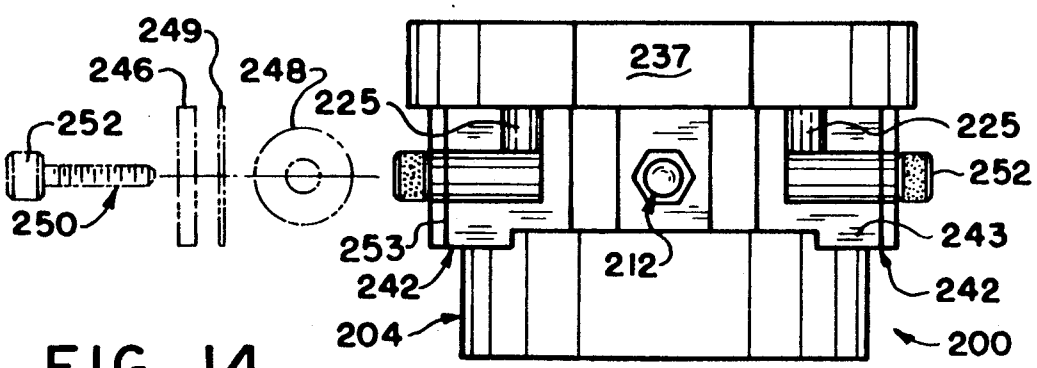
FIG. 14 is a top view of the combined microphone and amplifier assembly illustrated in FIG. 12.
Figure 16:
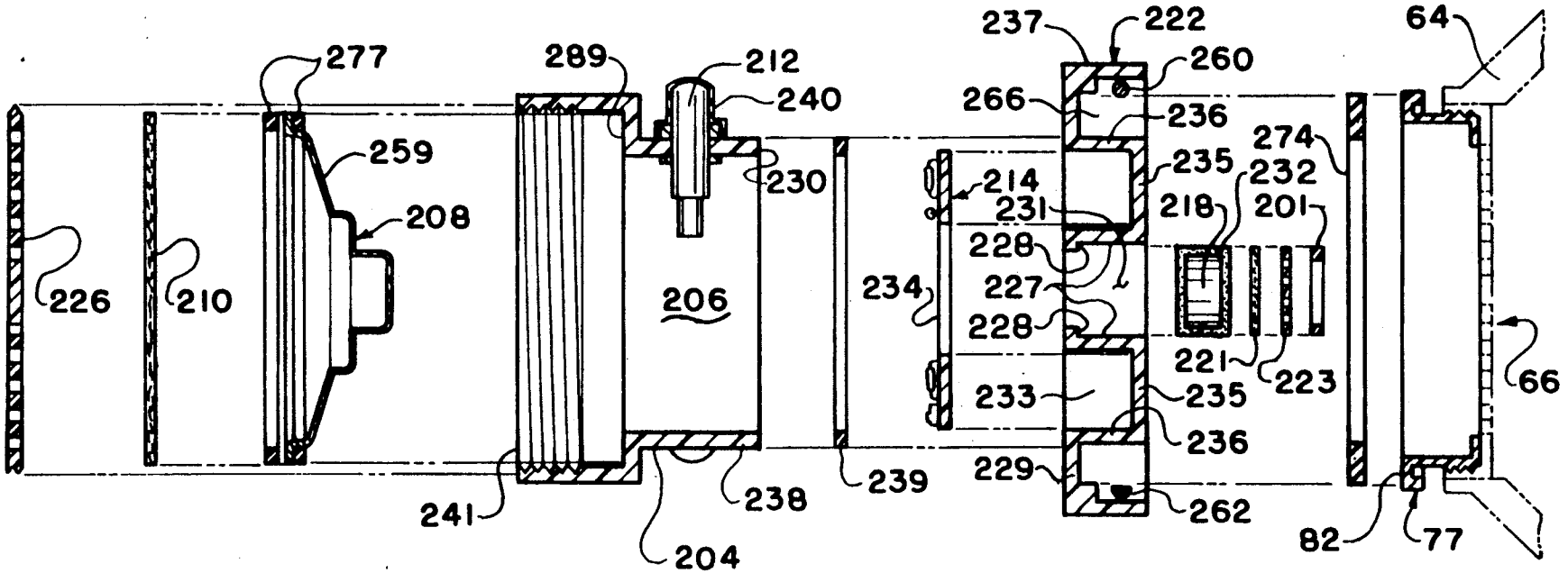
FIG. 16 is an exploded view of the combined microphone and amplifier assembly illustrated in FIG. 12.

Preferably, batteries 248 are connected in series and they each comprise replaceable three volt lithium batteries bearing designation PL213A. Also, in order to ensure that the battery compartments 242 are watertight, rubber gaskets 249 are provided as shown in FIG. 14. Gaskets 249 are disposed along the outer edges of covers 246 and they form a seal with the distal edges 253 of the sidewalls 243 that form compartments 242.

Provided in the mounting bracket 222 is an attachment assembly that facilitates the attachment of the combined microphone and amplifier assembly 200 to the sleeve 77 of the voice emitter passage 66 of the mask 64. The mounting bracket allows combined microphone and amplifier assembly 200 to be attached to a conventional mask 64 with no penetration or structural modification of the mask 64 or the voice emitter passage 66 of the mask 64. The attachment assembly includes a round stationary pin 260 and a rotatable locking pin 262 located in the circumferentially continuous outer wall or flange 237 of the mounting bracket 222. More particularly, as shown in FIGS. 13 and 16–18 stationary pin 260 comprises a cylindrical rod having its ends supported in a first solid or single wall portion 297 of flange 237 and it extends or protrudes into the annual cavity 266 of mounting bracket 222. Locking pin 262 comprises a cylindrical rod having a semi-circular central portion 268. The major axis of stationary pin 260 extends parallel to the major axes of the locking pin 262. Locking pin 262 extends through the second solid or single wall portion 298 of flange 237 and has its outer ends supported in pillow blocks 273 formed along the outside of flange 237. Included at one end of locking pin 262 is a spring clip 270 that serves to retain locking pin 262 in the flange 237 and pillow blocks 273 of mounting bracket 222 and a knurled knob 271 that allows a user to rotate the pin 262 within openings 272 located in pillow blocks 273.

Figure 13:
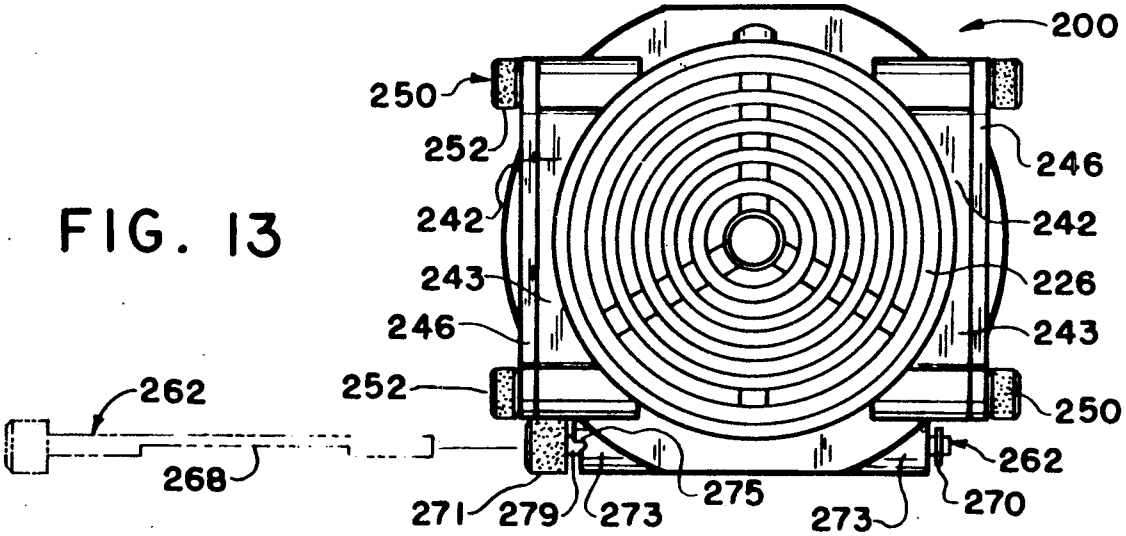
FIG. 13 is a front assembly or plan view of the combined microphone and amplifier assembly illustrated in FIG. 12.
Figure 17:
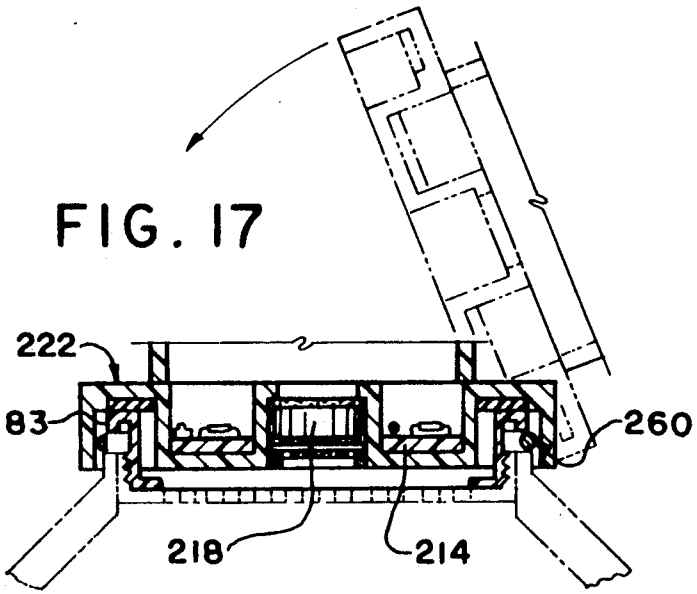
FIG. 17 is a cross-sectional view of the mounting bracket of the combined microphone and amplifier assembly of FIG. 12 in partial engagement with the voice emitter passage of a face mask.
Figure 18:
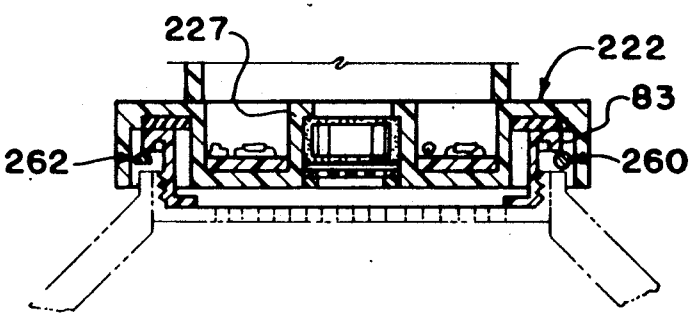
FIG. 18 is a cross-sectional view of the mounting bracket of the combined microphone and amplifier assembly of FIG. 12 in full engagement with the voice emitter passage of a face mask.
Figure 16A:
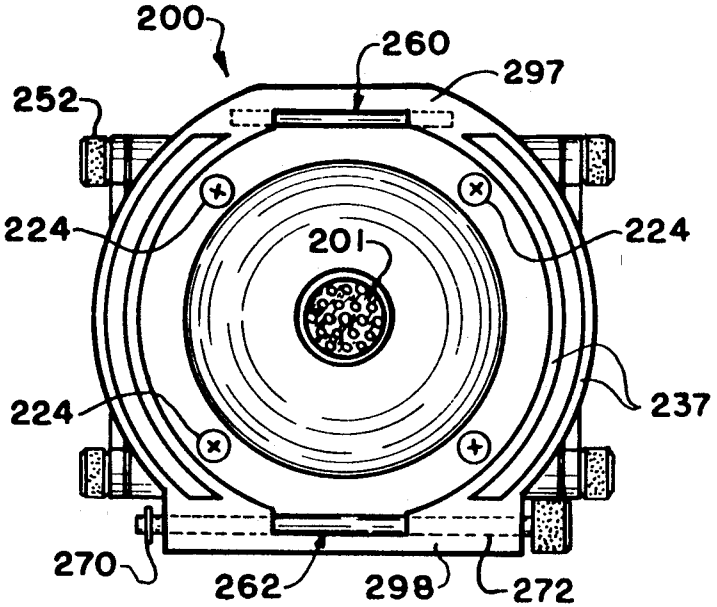
FIG. 16A is a rear view of the combined microphone and amplifier assembly illustrated in FIG. 12 with the rubber gasket located adjacent the flange of the mounting bracket removed.
Figure 19:
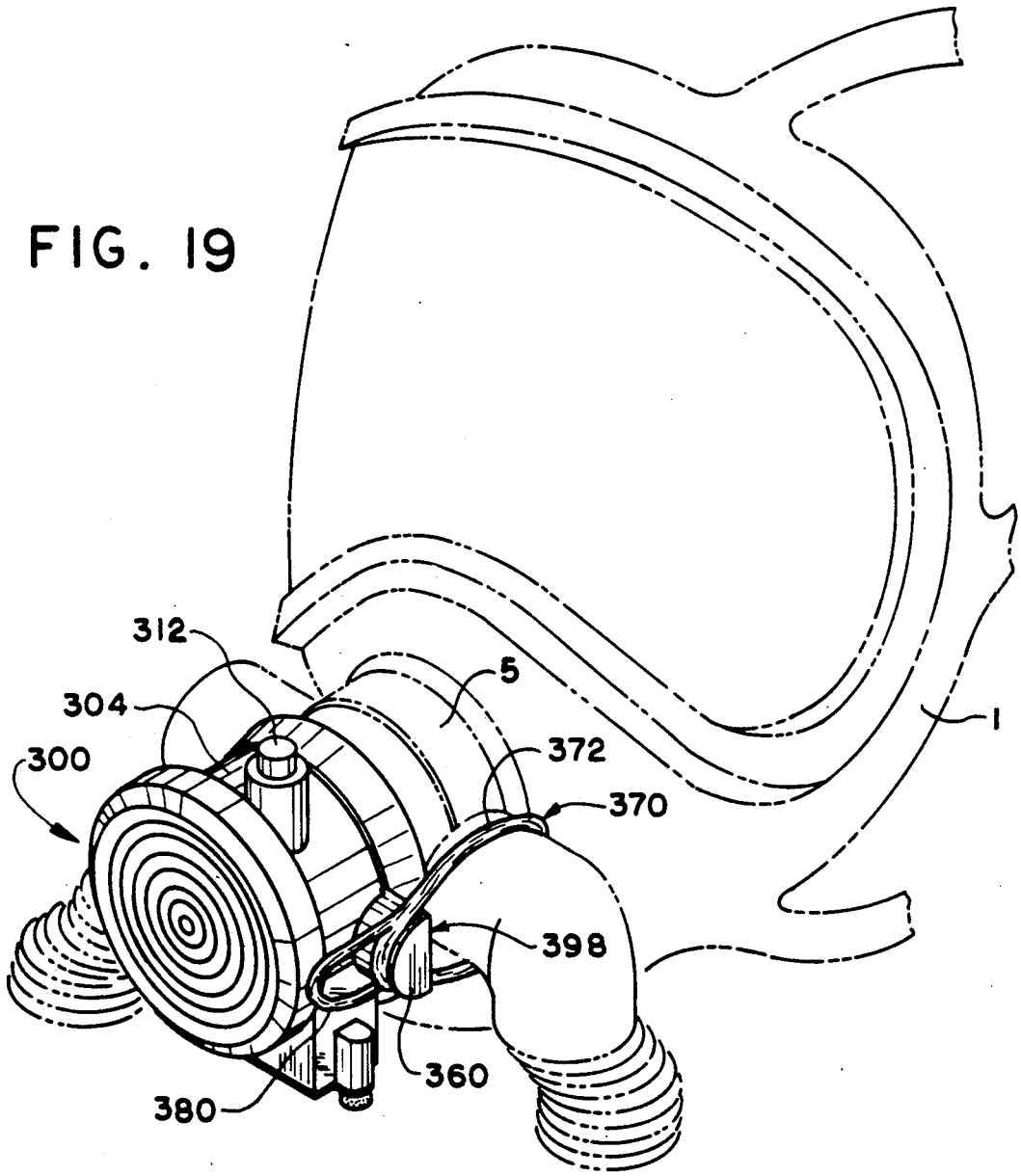
FIG. 19 is a front perspective view of another embodiment of a combined microphone and amplifier assembly made in accordance with the principles of the present invention attached to a face mask which is substantially similar to the mask illustrated in FIG. 1.
Figure 20:
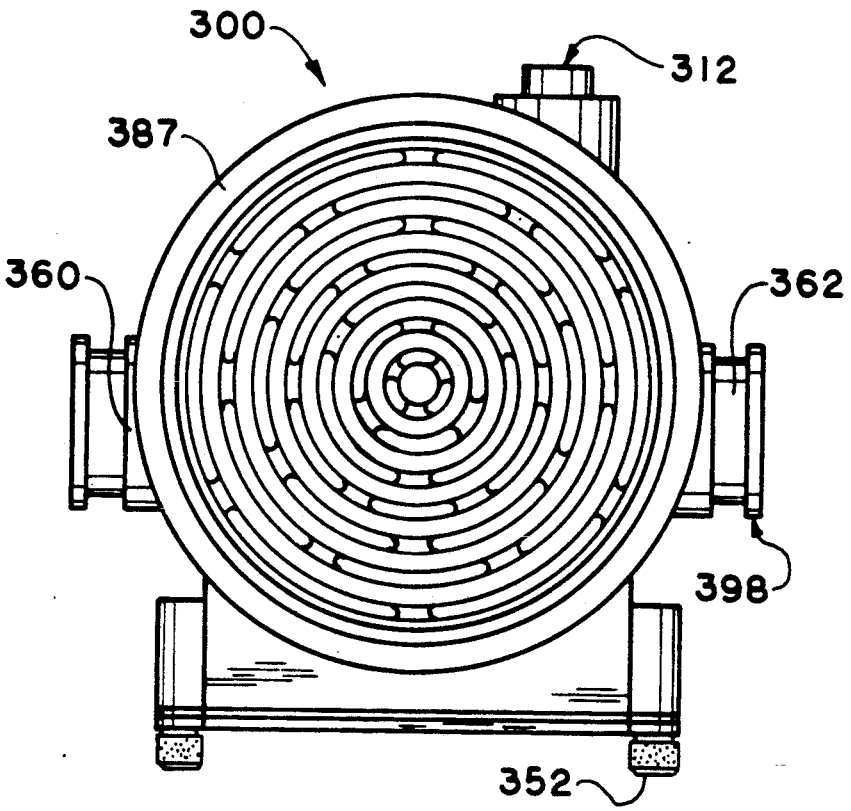
FIG. 20 is a front assembly for plan view of the combined microphone and amplifier assembly illustrated in FIG. 19.
Figure 21:
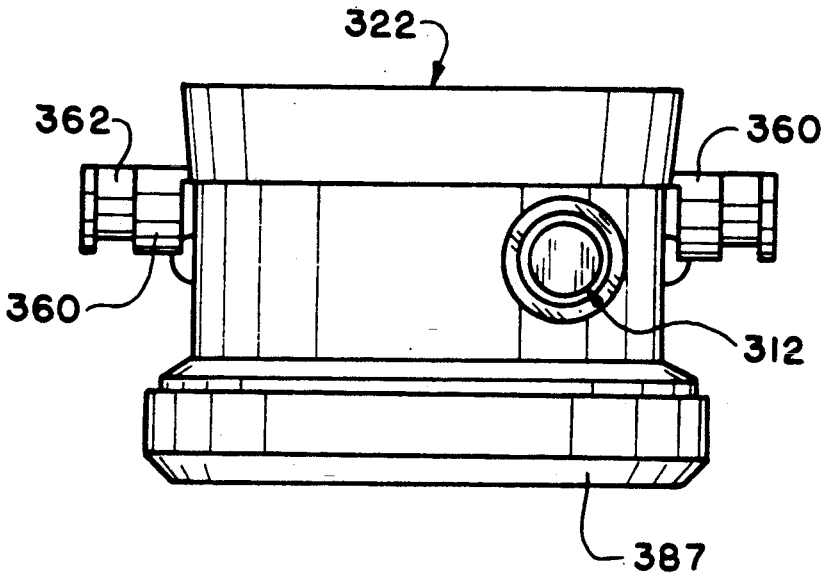
FIG. 21 is a top view of the combined microphone and amplifier assembly illustrated in FIG. 19.
Figure 22:
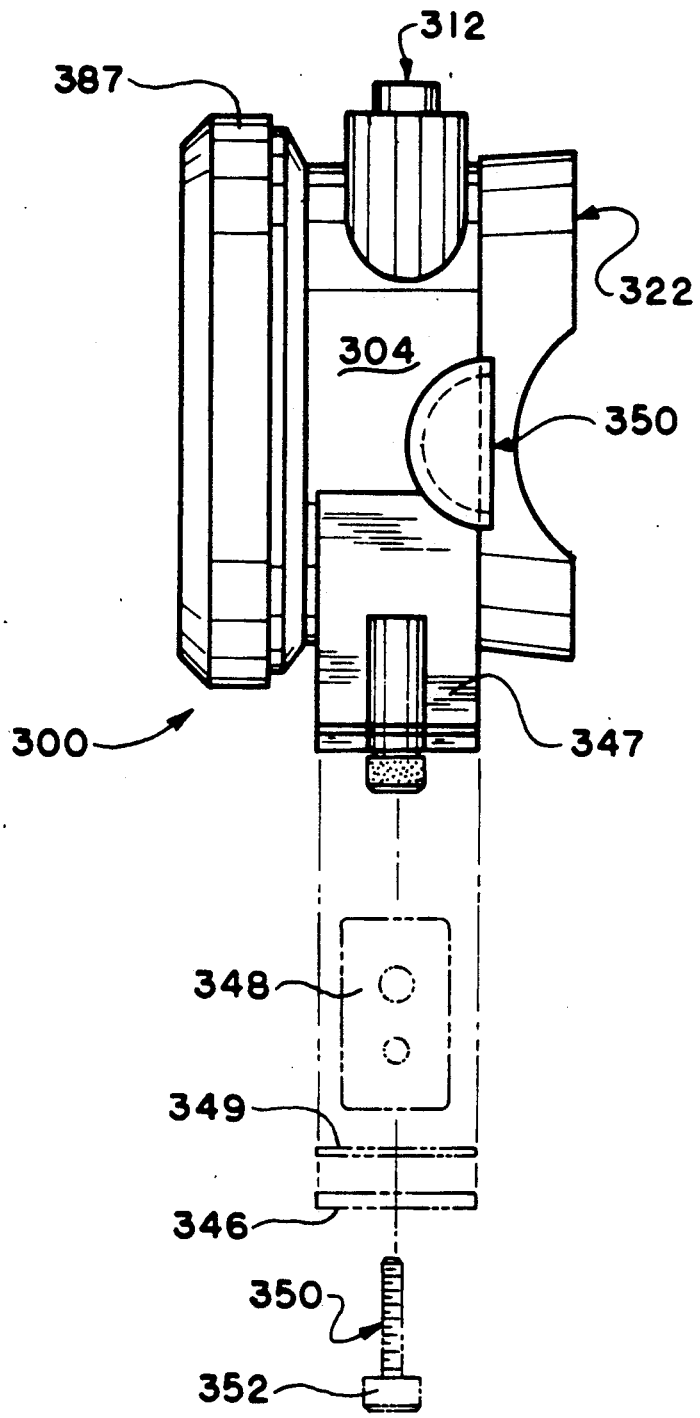
FIG. 22 is a right side view of the combined microphone and amplifier assembly illustrated in FIG. 19.

By rotating locking pin 262 counterclockwise, such that detent 279 contacts stop 275 as shown in FIG. 13, the central portion 268 of pin 262 creates minimal interference in the annular cavity 266 formed by flange 237 and rim 229 as shown in FIG. 17. A user may then position stationary pin 260 behind the lip 83 of sleeve 77, and then pivot the combined microphone and amplifier assembly 200 towards the sleeve 77 so as to align the gasket 274 in compressed contact with the rim 82 of sleeve 77. Then, a user can rotate locking pin 262 clockwise approximately 270° until detent 279 contacts the opposite side of stop 275, such that locking pin 262 creates an obstruction in annular cavity 266 as shown in FIG. 18 and engages the back edge of lip 83 thereby attaching the combined microphone and amplifier assembly 200 securely to mask 64 with gasket 274 in slight compression.

When gasket 274 is compressed between rim 82 of sleeve 77 and rim 229 of mounting bracket 222, gasket 274 provides a watertight and airtight seal between the mask 64 and the combined microphone and amplifier assembly 200. Compressed gasket 274 also serves to prevent sound and mechanical vibrations emanating from speaker 208 from returning to microphone 218 and creating feedback thereby helping to ensure superior sound production by the combined microphone and amplifier assembly 200.

In order to remove the combined microphone and amplifier assembly 200 a user merely has to rotate locking pin 262 approximately 270° in the opposite or counterclockwise direction until detent 279 contacts the first side of stop 275, thereby minimizing the obstruction created by pin 262 within annular cavity 266 so as to permit the locking pin 262 to disengage the back edge of the lip 83 of sleeve 77.

Illustrated in FIGS. 19–25 is yet another embodiment of a combined microphone and amplifier assembly 300 made in accordance with the principles of the present invention. Like the three previously illustrated embodiments, the combined microphone and amplifier assembly 300 can be mounted upon a conventional mask without special tools, without making threaded connections, and without structurally altering the mask including the voice emitter passage of the mask. Combined microphone and amplifier assembly 300 is adapted to be mounted upon the type of mask 1 which is substantially shown in FIGS. 1 and 9. Thus, in FIGS. 19 and 23–25 the same reference numerals have been employed as in FIGS. 1 and 9 to identify common elements.

Combined microphone and amplifier assembly 300 includes an integrally molded plastic body 304. The body 304 includes a main compartment 306 which houses the speaker 308, a circular piece of waterproof speaker cloth 310, a control switch 312, an amplifier circuit board 314 and a microphone 316 which is located in a microphone cavity 319 formed by annular sidewalls 317 protruding from the annular end wall 318 of body 304. Preferably, as in the previously illustrated embodiment, microphone 316 is disposed in a bed of foam rubber 320 in order to dampen vibrations, minimize feedback and enhance sound quality. As with the previous embodiment, microphone 316 may comprise a microphone sold by Primo Microphone Inc. sold under part no. EM78. Located behind microphone 316 is a circular piece of speaker cloth 301 and an annular plastic washer 302 which is compression fitted into the microphone cavity 319 flush with the rim 323 of the mounting bracket 322. Retaining circuit board 314 within main compartment 306 is a sheet metal screw 331 which is received in threaded post 332 extending from the end wall 318 of body 304.

Combined microphone and amplifier assembly 300 includes a mounting bracket 322 which facilitates attachment of the combined microphone and amplifier assembly 300 to the mask 1. Body 304 is secured to mounting bracket 322 utilizing a plurality of machine screws 324 which are threadedly received into star nuts (not shown) that are molded into the end wall of body 304 while the heads of screws 324 seat in the circular rim 323 of mounting bracket 322. Located between body 304 and mounting bracket 322 is a gasket 326 that helps to ensure a watertight and airtight seal between the rim 323 of the mounting bracket 322 and the end wall 318 of body 304. Gasket 326 also serves to dampen the transmission of vibrations between body 304 and mounting bracket 322. It will be appreciated that although mounting bracket 322 and body 304 are shown to be separate pieces, the present invention contemplates the production of body 304 and bracket 322 as a single piece.

Included in the rim 323 is an opening 325 adapted to receive the annular sidewalls 317 of microphone cavity 319. Included alongside the rim 323 is a circular foam rubber gasket 326. Gasket 326 serves to ensure superior sound reproduction and minimal feedback by dampening the transmission of vibrations from the mask 1 to the mounting bracket 322 and by providing a watertight and airtight seal between the mounting bracket 322 and the mask 64.

Located at the forward end 341 of the body 304 is the removable perforated end cap 387 that threadedly mounts to the outside diameter of the body 304. Preferably, speaker 308 is a four ohm, two watt waterproof speaker produced by In Tzong Enterprise. End cap 387 serves to retain the speaker cloth 310 and speaker 308 against lip 339 within main compartment 306. When end cap 387 is screwed into body 304, rubber annular gaskets 311, which are positioned adjacent both sides of the outer rim of the cone 313 of speaker 308, provide a watertight and airtight seal. In order to further ensure that the main compartment 306 is watertight preferably the switch 312 comprises as waterproof switch. An example of a suitable waterproof switch is one manufactured by Shigma, Inc. under part no. 8P1O11.

Positioned along the outside of the body 304 is a rectangular battery compartment 342 formed by sidewalls 335. Compartment 342 includes a removable cover 346 that provides quick and easy access to the battery 348 contained in the compartment 342. Cover 346 is held securely to compartment 342 by machine screws 350 which are threadedly received within threaded posts 347 formed along the sidewall 335 of compartment 342. By rotating threaded machine screws 350, which include oversized knurled heads 352 to allow easy grasping by a user's fingers, in the counterclockwise direction the cover 346 is easily removed. Thus, cover 346 may be removed and the battery 348 replaced while the combined microphone and amplifier assembly 300 is mounted to the mask 1 and the mask 1 is positioned on a user's face. The cover 346 is easily remounted upon the battery compartment 342 by aligning the ends of screws 350 with posts 347, and turning the screws 350 in the clockwise direction.

Figure 23:
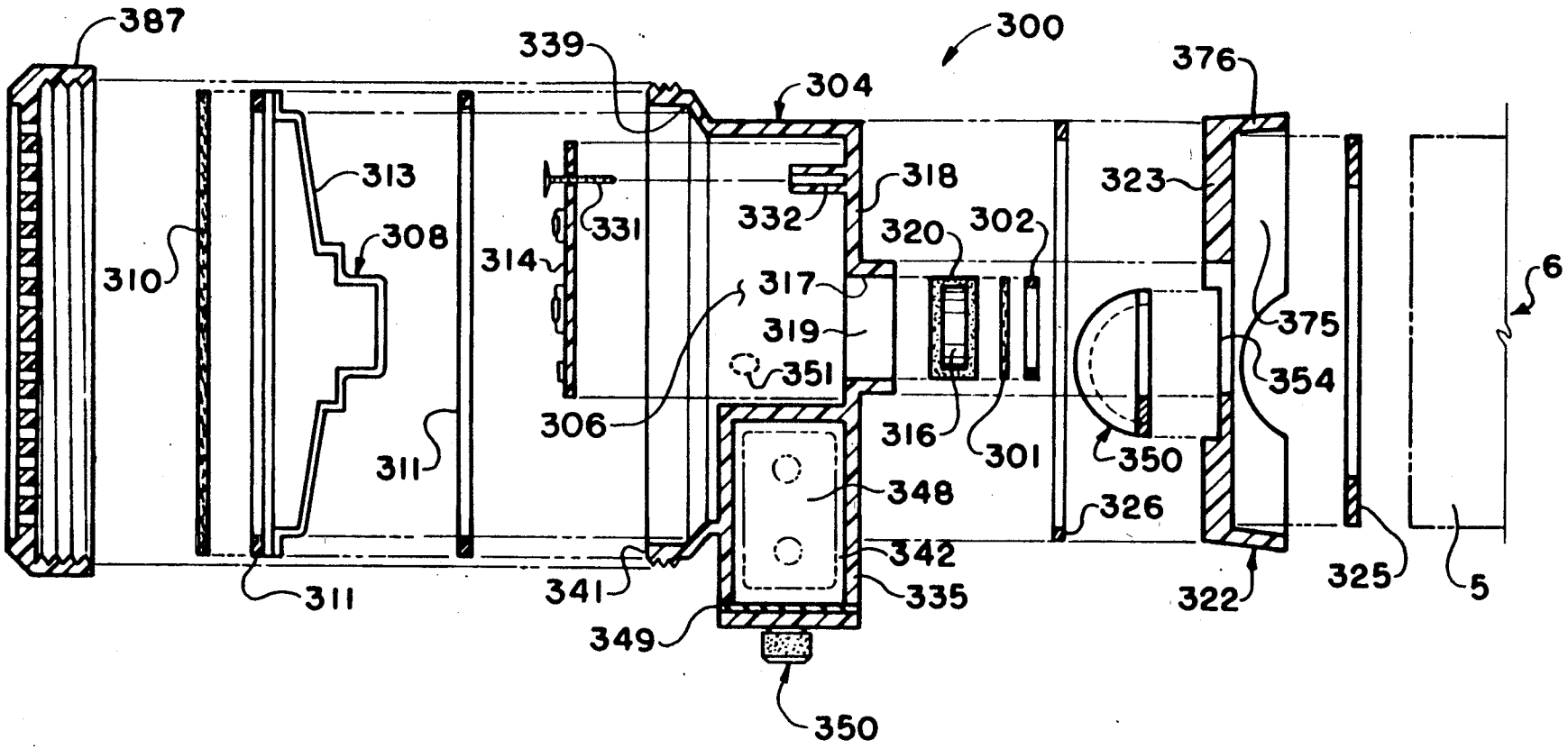
FIG. 23 is an exploded view of the combined microphone and amplifier assembly of FIG. 19.
Figure 23A:
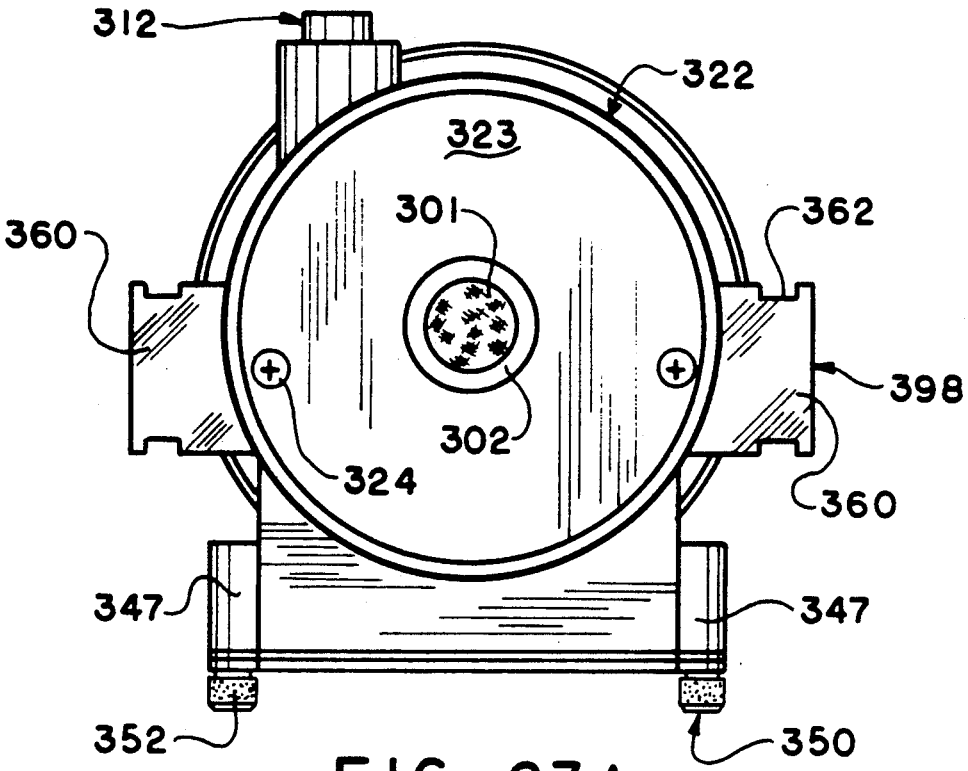
FIG. 23A is a rear view of the combined microphone and amplifier assembly illustrated in FIG. 19 with the rubber gasket located adjacent the flange of the mounting bracket removed.
Figure 23B:
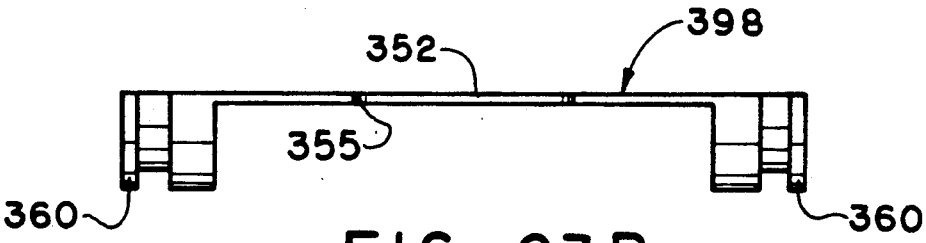
FIG. 23B is a top view of the mounting rod of the combined microphone and amplifier assembly illustrated in FIG. 19.
Figure 23C:
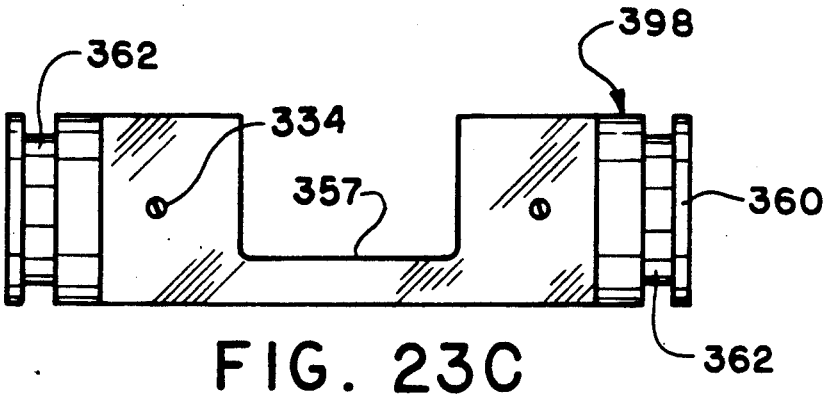
FIG. 23C is a front view of the mounting rod of the combined microphone and amplifier assembly illustrated in FIG. 19.

Preferably, battery 348 comprises a conventional replaceable nine volt alkaline battery. Also, in order to ensure that the compartment 342 is watertight, preferably a rubber gasket 349 as shown in FIG. 23 is included. Gasket 349 is disposed along the edges of cover 346 and it forms a seal with the distal ends of the side walls 335 of compartment 342.

Also included along the outside of the body 304 is a light indicator or LED 351 that lights up when switch 312 is placed in the "on" position. LED 351 provides an additional function in that if switch 312 is place in the "on" position and the batteries are weak, LED will not light. An example of an LED suitable for use with the present invention is a LED sold by Hewlett Packard under part number HLMP D150.

Included with the mounting bracket 322 is a mounting rod 398 that includes a pair of diametrically opposed semicircular posts 360 interconnected by a rectangular shape portion 352 of considerably reduced thickness. Posts 360 extend or protrude beyond the width of the body 304. The rectangular portion 352 of mounting rod 398 is located between mounting bracket 322 and body 304, within channel 354 formed by the rim 323 of mounting bracket 322. The rectangular portion 352 includes a rectangular cut-out 357 in order to accommodate the side walls 317 of microphone cavity 319. In order to ensure that mounting rod 398 is securely retained in channel 354, preferably at least a pair of machine screws 334 extend through openings 355 formed in mounting rod 398. Located near the distal ends of posts 360 are semicircular grooves 362.

Included on the manifold shoulders 149 of the mask 1 and forming a removable part of mounting bracket 322 are a pair of constant elasticity deformable rubber straps 370. Straps 370 include an inner circular loop 372 and an outer semicircular loop 380. The cross-section of the straps 370 is circular almost entirely throughout. Straps 370 are mounted on the manifold shoulders 149 of mask 1 during the assembly of manifold shoulders 149 by inserting shoulders 149 through the inner loops 372 of straps 370.

Figure 24:
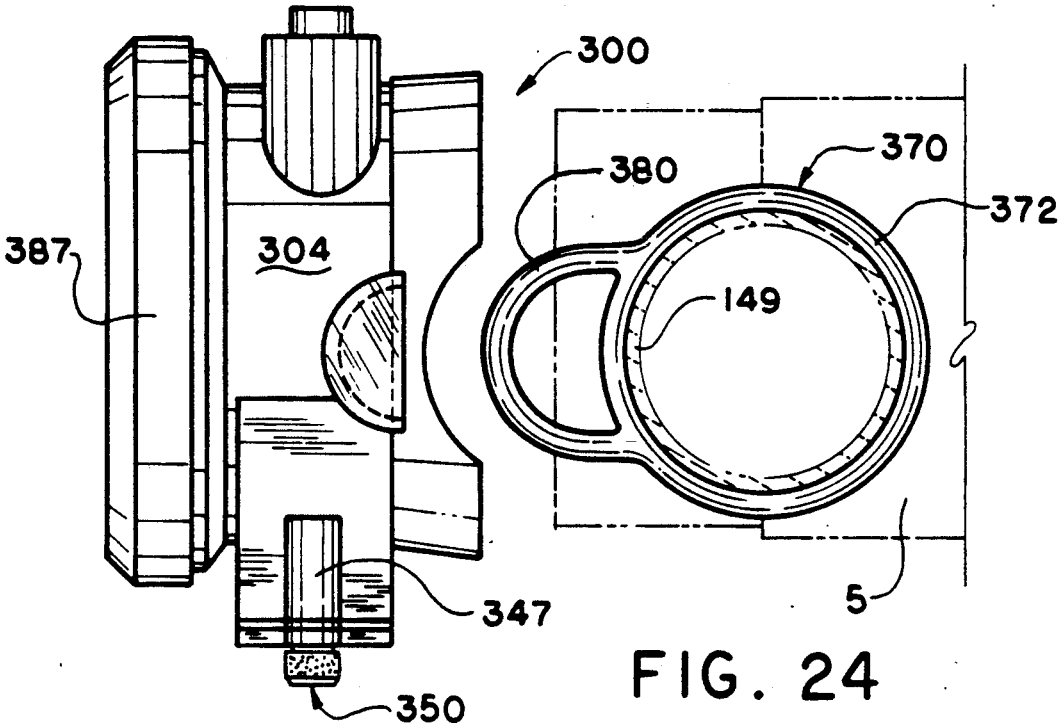
FIG. 24 is a right side view of the combined microphone and amplifier assembly shown in FIG. 19 just prior to attachment to the voice emitter passage of a face mask.
Figure 25:
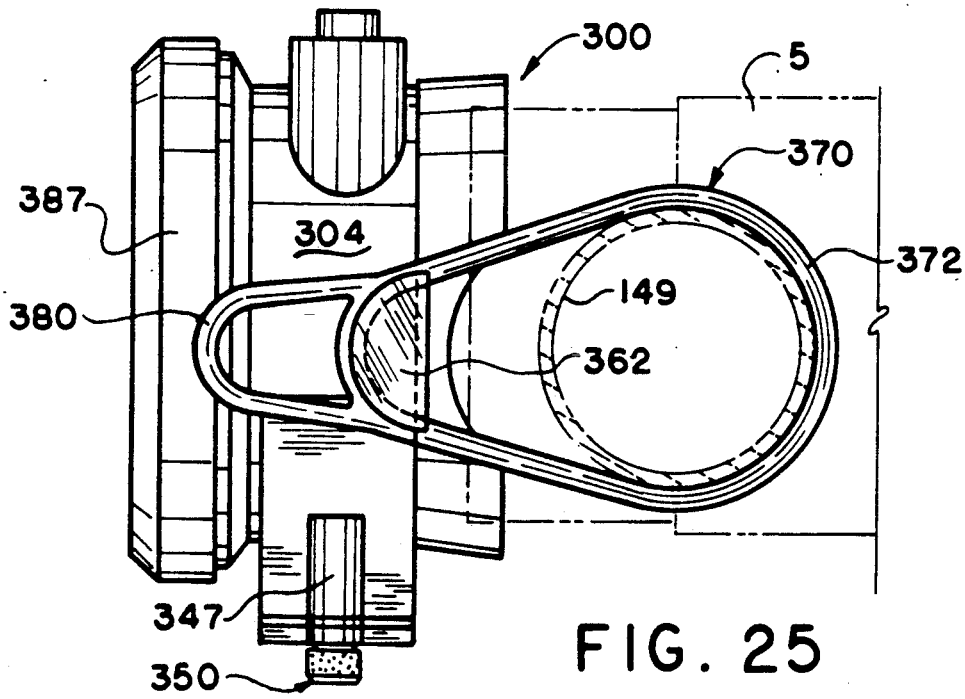
FIG. 25 is a right side view of the combined microphone and amplifier assembly shown in FIG. 19 subsequent to its attachment to the voice emitter passage of a face mask.

As shown in FIG. 24, combined microphone and amplifier assembly 300 is attached to the mask 1 by first aligning the assembly 300 relative to the voice emitter body 5 of the voice emitter passage 6 of the mask 1 such that the body 5 is received within the cylindrical cavity 375 formed by the annular flange 376 of the mounting bracket 322. Then, the user pulls upon the outer loop 380 of the straps 370 until the inner loop 372 is deformed so as to permit the inner loop 372 to be stretched around the posts 360 and securely engage the grooves 362 formed in the posts 360 as shown in FIG. 25. As straps 370 are stretched around posts 360, substantially the same tension is applied throughout the stretching process due to the constant elasticity properties of straps 320. After the inner loops 372 are stretched around the posts 360, the residual elastic tension in inner loop 372 serves to retain the combined microphone and amplifier assembly 300 upon the body 5 and compress gasket 325 providing a watertight and airtight seal between the mask 1 and the combined microphone and amplifier assembly 300. The outer loops 380 of straps 370 may then be easily grasped by a user and pulled off of the posts 360 in order to allow a user to remove the combined microphone and amplifier assembly 300 from the emitter body 5 of mask 1.

Figure 26:
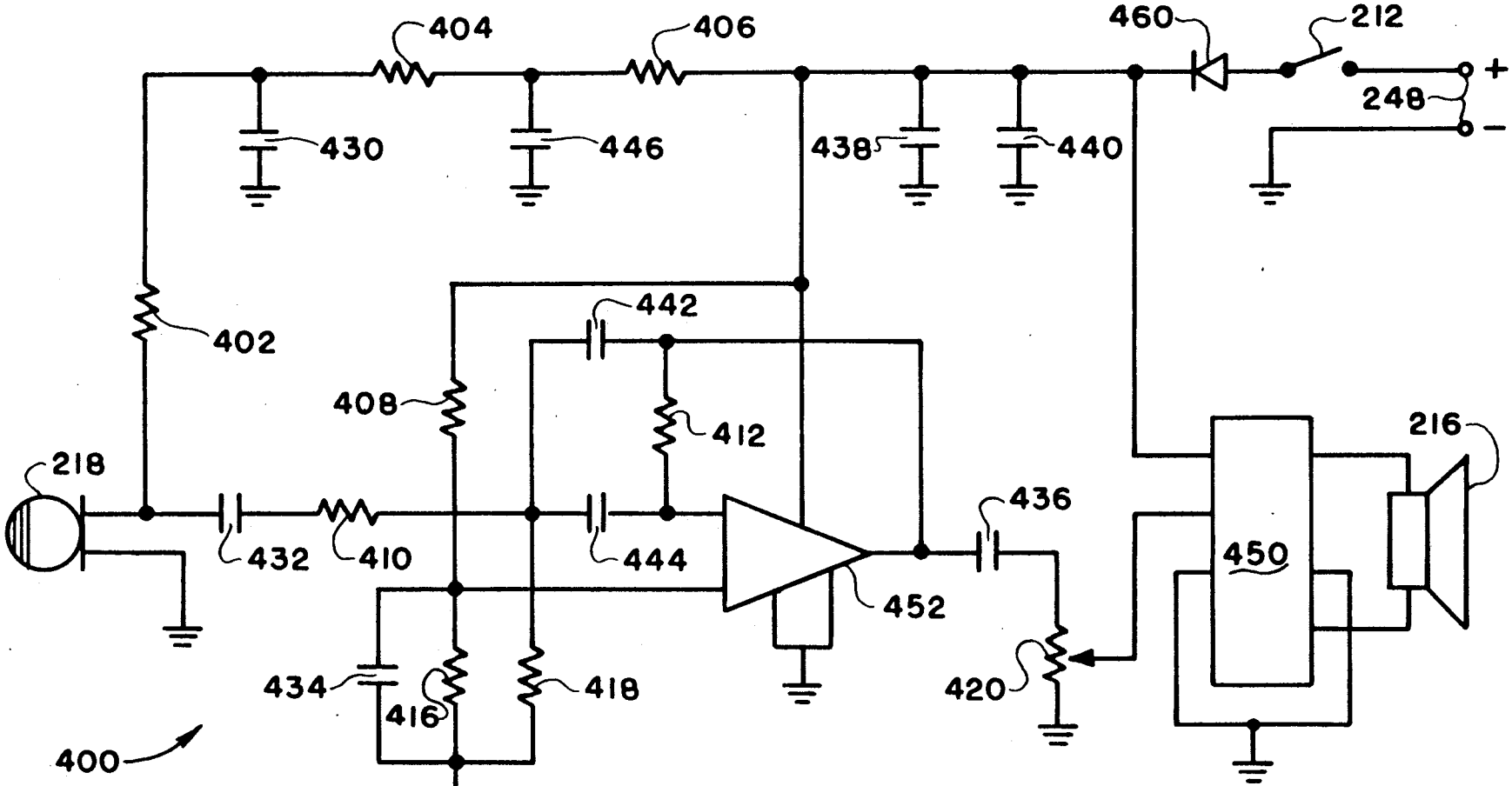
FIG. 26 is an electrical schematic for the combined microphone and amplifier assembly illustrated in FIG. 12.

Referring now to FIG. 26 there is illustrated an electrical circuit 400 suitable for use with the combined microphone and amplifier assembly 200. Circuit 400 includes the speaker 216, the microphone 218, switch 212, and batteries 248. Circuit 400 also includes a plurality of resistors. The following is a tabulation of the resistors indicating their respective resistance:

| Reference Numeral | Resistance in Kilohms |
|---|---|
| 402 | 4.7 |
| 404 | 2.2 |
| 406 | 2.2 |
| 408 | 100 |
| 410 | 5.1 |
| 412 | 10 |
| 416 | 100 |
| 418 | 2.2 |

Circuit 400 also includes a twenty Kilohm variable pot type resistor 420, that allows the gain in circuit 400 to be adjusted to match the voice emitter passage of the mask to which combined microphone and amplifier assembly 200 is attached, so as to maximize the quality of the sound reproduced by the combined microphone and amplifier assembly 200.

Circuit 400 also includes a plurality of capacitors. The following is a tabulation of the various capacities of the capacitors:

| Reference Numeral | Capacity in Microfarads |
|---|---|
| 430 | 3.3 |
| 432 | .1 |
| 434 | 3.3 |
| 436 | .1 |
| 438 | .1 |
| 440 | 220 |
| 442 | .01 |
| 444 | .01 |
| 446 | 3.3 |

Circuit 400 also includes the on/off switch 212 and the two three volt batteries 248 which are connected in series to provide a total of six volts to the circuit 400. Also included in the circuit 400 is an audio power amplifier sold by Signetics a division of North American Phillips Corporation under the part no. TDA 7052 and an operational amplifier filter 452 manufactured by Texas Instruments under part no. TLC 271. Operational amplifier 452 in conjunction with the other components of circuit 400 provides an active filter that serves to enhance the quality of sound emanating from speaker 216 by removing all of the frequency of sound not contributing to sound clarity, such removed frequencies only causing sound distortion by overloading the speaker 216, thereby allowing only the most audible frequencies of sound to be amplified by audio amplified 450. The active filter also serves to extend the life of batteries 248.

Also included in the circuit 400 is a diode 460 sold by Motorola under part no. IN 4007. Except for speaker 216, switch 212, microphone 218 and batteries 248, all of the other components of circuit 400 are mounted on and form amplifier circuit board 214 shown in FIG. 16.

Figure 27:
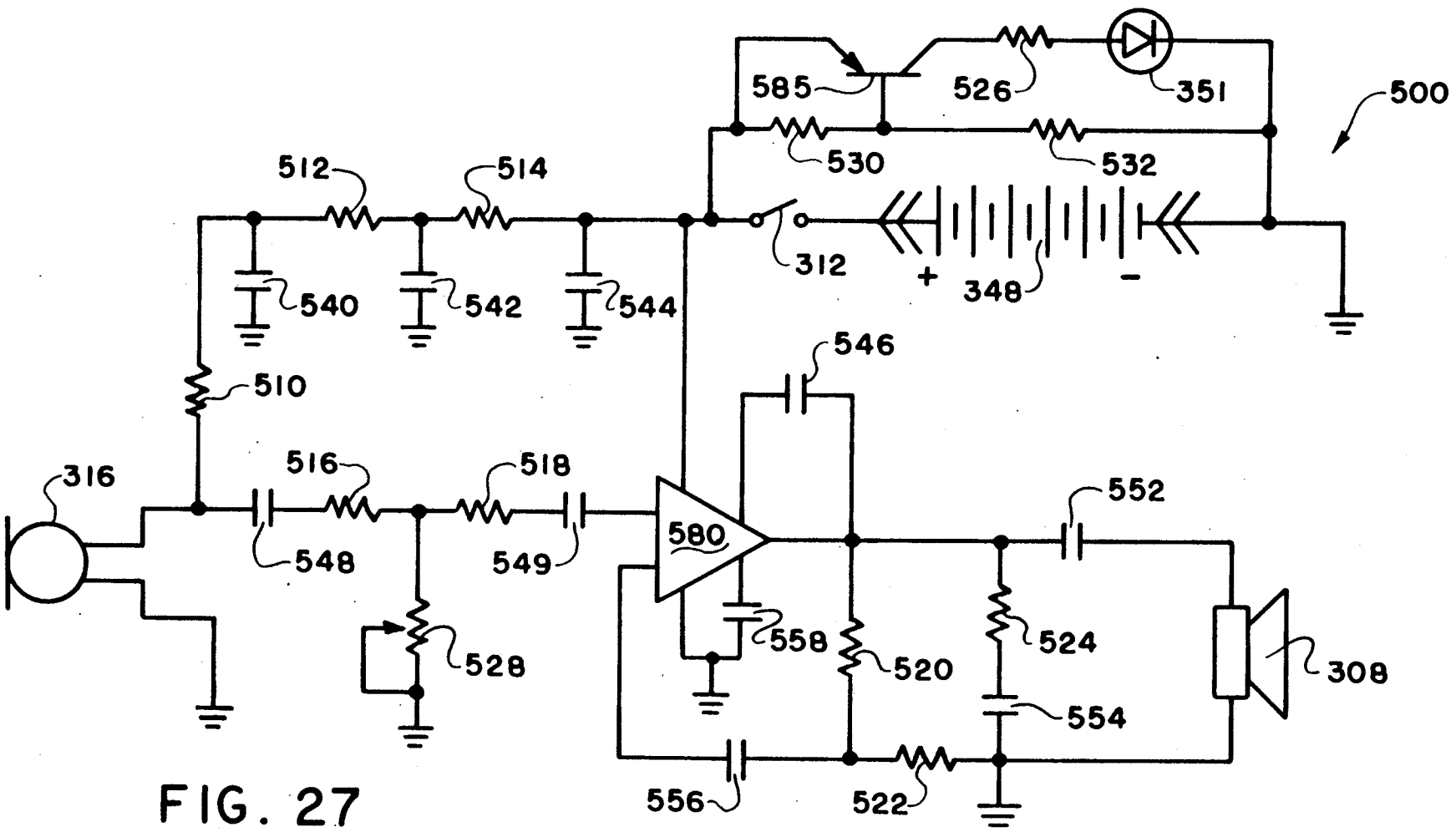
FIG. 27 is an electrical schematic for the combined microphone and amplifier assembly illustrated in FIG. 19.

Referring now to FIG. 27 there is illustrated an electrical circuit 500 suitable for use with the combined microphone and amplifier assembly 300. Circuit 500 includes the microphone 316, the battery 348, speaker 308, switch 312 and LED 351. Circuit 500 also includes a plurality of resistors. The following is a tabulation of the resistors indicating their respective resistance:

| Reference Numeral | Resistance |
|---|---|
| 510 | 10 Kilohms |
| 512 | 2.2 Kilohms |
| 514 | 2.2 Kilohms |

-continued

| Reference Numeral | Resistance |
|---|---|
| 516 | 10 Kilohms |
| 518 | 22 Kilohms |
| 520 | 10 Kilohms |
| 522 | 100 Ohms |
| 525 | 4.7 Ohms |
| 526 | 4.7 Kilohms |
| 530 | 22 Kilohms |
| 532 | 20 Kilohms |

Circuit 500 also includes a 20 Kilohm variable pot resistor 528 that allows the gain in circuit 500 to be adjusted to match the requirements of voice emitter passage of the mask upon which the combined microphone and amplifier assembly 300 is mounted in order to provide optimum sound reproduction.

Circuit 500 also includes a plurality of capacitors. The following is a tabulation of the capacity of the various capacitors:

| Reference Numerals | Capacity in Microfarads |
|---|---|
| 540 | 10 |
| 542 | 10 |
| 544 | .1 |
| 546 | 47 |
| 548 | .0033 |
| 549 | 1 |
| 552 | 220 |
| 554 | .22 |
| 556 | 1 |
| 558 | 22 |

Also included in the circuit 500 is an audio amplifier 580 produced by SGS-Thomson and sold under part no. TDA 1904. Preferably, amplifier 580 includes a heat sink to ensure continual high quality sound throughout the entire time period combined microphone and amplifier assembly 300 is in operation. Also included in the circuit 500 is the on-off indicator light 351 and a transistor 585 manufactured by National Semiconductor and sold under part no. 2N3906. With the exception of the speaker 308, switch 312, microphone 316, batteries 348, and LED 351, all of the other components of circuit 500 are mounted on and form amplifier board 314 shown in FIG. 23.

It will be apparent from the foregoing that changes may be made in the details of construction and configuration without department from the spirit of the invention as defined in the following claims.

We claim:

1. A voice transmission system for a protective face mask having a voice emitter passage forming an extension of the face mask with its inner proximate a person's mouth wearing the mask and its outer end having a voice diaphragm, said voice transmission system comprising:

a body mounting and substantially enclosing an amplifier assembly and a speaker within an open-ended main compartment and at least partially enclosing a microphone within a microphone cavity which serves to receive and amplify the person's voice, and a battery compartment adapted to contain a battery, said battery compartment including a selectively removable cover to allow access to said battery;

said amplifier assembly, speaker, battery and microphone being interconnected by an electrical circuit; and a mounting bracket connected to said body, said mounting bracket having mounting means for removably coupling the voice transmission system to the outer end of the voice emitter passage to receive, amplify and transmit the person's voice received through the voice emitter diaphragm.

2. A voice transmission system for use with a protective face mask having a voice emitter passage with its inner end proximate a person's mouth wearing the mask and its outer end having a voice diaphragm, said voice transmission system comprising:

a body mounting and substantially enclosing an amplifier assembly and a speaker within a main compartment and least partially enclosing a microphone within a microphone cavity;

an electrical circuit interconnecting said amplifier assembly and microphone with at least one battery, and a mounting bracket attached to said body having mounting means for removably coupling said voice transmission system to the mask proximate to the person's mouth without penetrating or structurally modifying the mask.

3. A combined microphone and amplifier assembly as set forth in claim 2 wherein said body includes a battery compartment for housing said battery, said battery compartment including a removable cover providing access to said battery.

4. A combined microphone and amplifier assembly for use with a protective face mask having a voice emitter passage, said combined microphone and amplifier assembly comprising:

a microphone, an amplifier board, a speaker, at least one battery and an electrical circuit interconnecting said microphone, amplifier board, speaker and battery;

a body mounting an substantially enclosing said microphone, amplifier board and said speaker within a main compartment;

a mounting bracket attached to said body having connecting means for removably securing said combined microphone and amplifier assembly to the mask in juxta position on and in alignment with the voice emitter passage without penetrating the mask or structurally modifying the mask, said connecting means comprising a round stationary rod and a substantially round rotatable locking pin, said stationary pin being adapted to engage the voice emitter passage of the mask, said rotatable locking pin being capable of rotating in and out of locking engagement with the voice emitter passage of the mask so as to allow said combined microphone and amplifier assembly to be attached and detached from the mask.

5. A combined microphone and amplifier assembly as set forth in claim 4 wherein said mounting bracket includes a circular flange and the ends of said stationary pin are supported in said flange.

6. A combined microphone and amplifier assembly as set forth in claim 5 wherein the ends of said locking pin extend through said flange, said ends of said locking pin being supported by pillow blocks located along the outside of said flange.

7. A combined microphone and amplifier assembly as set forth in claim 6 wherein the major axes of said stationary pin and said locking pin extend parallel to one another.

8. A combined microphone and amplifier assembly as set forth in claim 7 wherein said locking pin includes a reduced diameter semicircular portion that is capable of being rotated in and out of engagement with the voice emitter passage of the face mask.

9. A combined microphone and amplifier assembly as set forth in claim 8 wherein said mounting bracket includes a microphone cavity for housing said microphone.

10. A combined microphone and amplifier assembly as set forth in claim 9 wherein said mounting bracket includes a rim and a gasket located alongside said rim, such that when said combined microphone and amplifier assembly is mounted upon the mask said gasket is located between the mask and said rim, said gasket being slightly compressed so as to provide an airtight and watertight seal between said mounting bracket and said mask when said locking pin is in engagement with the sleeve of the voice emitter passage of the mask.

11. A combined microphone and amplifier assembly for use with a protective face mask having a voice emitter passage, said combined microphone and amplifier assembly comprising:

a microphone, an amplifier board, a speaker, at least one battery and an electrical circuit interconnecting said microphone, amplifier board, speaker and battery;

a body mounting and substantially enclosing said microphone, amplifier board and said speaker within a main compartment;

a mounting bracket attached to said body having connecting means for removably securing said combined microphone and amplifier assembly to the mask in juxta position on and in alignment with the voice emitter passage without penetrating or structurally modifying the mask, said connection means comprising a mounting rod having a pair of posts that extend beyond said body and a pair of elastic straps that connect said posts to the manifolds of the mask, said straps including an inner loop and an outer loop, said outer loop serving to allow a user to grasp said straps and stretch said inner loop around said posts to mount said combined microphone and amplifier assembly to the mask.

12. A combined microphone and amplifier assembly as set forth in claim 11 wherein said straps comprise constant elasticity rubber straps.

13. A combined microphone and amplifier assembly as set forth in claim 12 wherein said posts include grooves adapted to receive said inner loops of said straps.

14. A combined microphone and amplifier assembly as set forth in claim 13 wherein said inner loops of said straps are circular and said outer loops are semicircular.

15. A combined microphone and amplifier assembly as set forth in claim 14 wherein said posts are diametrically opposed to one another.

16. A combined microphone and amplifier assembly as set forth in claim 15 wherein said mounting rod is partially located between said body and said mounting bracket.

17. A combined microphone and amplifier assembly as set forth in claim 16 wherein said mounting bracket includes a rim and a gasket adjacent said rim such that when said combined microphone and amplifier assembly is mounted upon the mask the gasket is located between said rim and the mask, said straps provide sufficient elastic tension so as to partially compress said gasket and provide an airtight and watertight seal between said mounting bracket and the mask once said inner loops of said straps have been stretched around said posts of said mounting rod.

18. A combined microphone and amplifier assembly as set forth in claim 17 wherein said straps include circular cross-sections substantially throughout said straps.

19. A combined microphone and amplifier assembly for use with a protective face mask having a voice emitter passage forming an extension of the face mask, said combined microphone and amplifier assembly comprising:

a microphone, an amplifier board, a speaker, at least one battery and an electrical circuit interconnecting said microphone, amplifier board, speaker and battery;

a body mounting and substantially enclosing said amplifier board and said speaker within a main compartment;

a mounting bracket attached to said body having connection means for removably securing said combined microphone and amplifier assembly to the mask proximate to the person's mouth without penetrating or structurally modifying the mask, said connection means including a mounting rod having a pair of posts that extend beyond said body and a pair of elastic straps which connect said posts to the manifolds of the mask thereby mounting said combined microphone and amplifier assembly to the mask.

* * * * *

UNITED STATES PATENT AND TRADEMARK OFFICE

CERTIFICATE OF CORRECTION

PATENT NO. : 5,138,666

DATED : August 11, 1992

INVENTOR(S) : Alfred Bauer, et al.

It is certified that error appears in the above-identified patent and that said Letters Patent is hereby corrected as shown below:

Col. 17, line 55 please insert --end-- after "inner" before "proximate"

Signed and Sealed this

Twenty-eighth Day of September, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,138,666

DATED : August 11, 1992

INVENTOR(S) : Bauer et al.

It is certified that error appears in the above-identified patent and that said Letters Patent is hereby corrected as shown below:

Col. 18, line 40 please delete "an" insert therefore --and--

Col. 18, line 44 please delete "connecting" insert therefore --connection--

Col. 18, line 48,49 delete "connecting" insert therefore --connection--

Col. 19, line 35 delete "connecting" insert therefore --connection--

Signed and Sealed this

Twenty-second Day of July, 1997

Bruce Lehman

*Attest:*

BRUCE LEHMAN

*Attesting Officer*

*Commissioner of Patents and Trademarks*

UNITED STATES PATENT AND TRADEMARK OFFICE
Certificate

Patent No. 5,138,666 Patented: August 11, 1992

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Alfred Bauer, Parma, OH (US); Thomas A. Dobbins, Coshocton, OH (US); Alexander Shaland, Lyndhurst, OH (US).

Signed and Sealed this Eleventh of March 2008.

JASON CHAN
*Supervisory Patent Examiner*
Art Unit 2613